US010854978B2

(12) United States Patent
Lim et al.

(10) Patent No.: US 10,854,978 B2
(45) Date of Patent: Dec. 1, 2020

(54) ANTENNA APPARATUS AND ANTENNA MODULE

(71) Applicant: Samsung Electro-Mechanics Co., Ltd., Suwon-si (KR)

(72) Inventors: Dae Ki Lim, Suwon-si (KR); Ju Hyoung Park, Suwon-si (KR); Jeong Ki Ryoo, Suwon-si (KR); Nam Ki Kim, Suwon-si (KR); Myeong Woo Han, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 35 days.

(21) Appl. No.: 16/251,552

(22) Filed: Jan. 18, 2019

(65) Prior Publication Data

US 2019/0326672 A1 Oct. 24, 2019

(30) Foreign Application Priority Data

Apr. 23, 2018 (KR) ..... 10-2018-0046817
Aug. 9, 2018 (KR) ..... 10-2018-0093002

(51) Int. Cl.
*H01Q 9/04* (2006.01)
*H01Q 1/52* (2006.01)
(Continued)

(52) U.S. Cl.
CPC ..... *H01Q 9/0414* (2013.01); *H01Q 1/526* (2013.01); *H01Q 19/005* (2013.01); *H01Q 19/30* (2013.01)

(58) Field of Classification Search
CPC ..... H01Q 1/22; H01Q 1/2283; H01Q 1/36; H01Q 1/38; H01Q 1/52; H01Q 1/526;
(Continued)

(56) References Cited

U.S. PATENT DOCUMENTS 4,835,538 A * 5/1989 McKenna ..... H01Q 9/0414 343/700 MS
5,497,164 A * 3/1996 Croq ..... H01Q 9/0414 343/700 MS
(Continued)

FOREIGN PATENT DOCUMENTS

CN 102007519 A 4/2011
CN 206098713 U 4/2017
(Continued)

OTHER PUBLICATIONS

Korean Office Action dated Jun. 21, 2019 in corresponding Korean Patent Application No. 10-2018-0093002 (6 pages, 5 pages in Korean).
(Continued)

*Primary Examiner* — Jason Crawford
(74) *Attorney, Agent, or Firm* — NSIP Law

(57) ABSTRACT

An antenna apparatus includes a ground layer having a through-hole; a feed via disposed to pass through the through-hole; a patch antenna pattern disposed on the ground layer and electrically connected to one end of the feed via; a first coupling patch pattern disposed on the patch antenna pattern; a second coupling patch pattern disposed between the first coupling patch pattern and the patch antenna pattern; and a dielectric layer disposed in at least of a portion a space between the first coupling patch pattern and the second coupling patch pattern so that a dielectric constant of at least a portion of a space between the patch antenna pattern and the second coupling patch pattern is lower than a dielectric constant of the space between the first coupling patch portion and the second coupling patch pattern.

14 Claims, 17 Drawing Sheets

(51) Int. Cl.
*H01Q 19/30* (2006.01)
*H01Q 19/00* (2006.01)

(58) Field of Classification Search
CPC .... H01Q 19/005; H01Q 21/06; H01Q 21/065; H01Q 21/29; H01Q 9/0407; H01Q 9/0414; H01Q 5/378; H01Q 5/385
See application file for complete search history.

(56) References Cited

U.S. PATENT DOCUMENTS

| | | | | |
|---|---|---|---|---|
| 6,091,373 | A * | 7/2000 | Raguenet | H01Q 9/0414 333/137 |
| 7,102,571 | B2 * | 9/2006 | McCarrick | H01Q 1/38 343/700 MS |
| 9,853,359 | B2 * | 12/2017 | Elsherbini | H01Q 21/067 |
| 10,468,764 | B2 | 11/2019 | Kugler et al. | |
| 2007/0126638 | A1 * | 6/2007 | Channabasappa | H01Q 9/0442 343/700 MS |
| 2009/0256752 | A1 | 10/2009 | Akkermans et al. | |
| 2010/0190464 | A1 * | 7/2010 | Chen | H01Q 9/0407 455/334 |
| 2016/0049723 | A1 * | 2/2016 | Baks | H01Q 1/2291 343/848 |
| 2016/0336646 | A1 | 11/2016 | Baek et al. | |
| 2017/0125895 | A1 | 5/2017 | Baks et al. | |
| 2018/0062255 | A1 * | 3/2018 | Kugler | H01Q 1/38 |
| 2018/0159203 | A1 * | 6/2018 | Baks | H01Q 9/0407 |
| 2018/0205155 | A1 | 7/2018 | Mizunuma et al. | |
| 2019/0027802 | A1 * | 1/2019 | Noori | H01Q 15/0086 |
| 2019/0326674 | A1 * | 10/2019 | Kang | H01L 24/13 |

FOREIGN PATENT DOCUMENTS

| | | | |
|---|---|---|---|
| CN | 106910999 | A | 6/2017 |
| CN | 107258035 | A | 10/2017 |
| CN | 107646156 | A | 1/2018 |
| JP | 2001-326319 | A | 11/2001 |
| KR | 10-2009-0068799 | A | 6/2009 |
| KR | 10-2011-0005250 | A | 1/2011 |
| KR | 10-1164618 | B1 | 7/2012 |
| KR | 10-2016-0132649 | A | 11/2016 |
| WO | WO 03/041222 | A1 | 5/2003 |
| WO | WO 2009/128866 | A1 | 10/2009 |
| WO | WO 2016/182252 | A1 | 11/2016 |
| WO | WO 2017/047396 | A1 | 3/2017 |

OTHER PUBLICATIONS

Chinese Office Action dated May 18, 2020 in corresponding Chinese Patent Application No. 201910241422.0 (21 pages in English, 14 pages in Chinese).

* cited by examiner

ANTENNA APPARATUS AND ANTENNA MODULE

CROSS-REFERENCE TO RELATED APPLICATION

This application claims the benefit under 35 USC 119(a) of Korean Patent Application No. 10-2018-0046817 filed on Apr. 23, 2018 and Korean Patent Application No. 10-2018-0093002 filed on Aug. 9, 2018 in the Korean Intellectual Property Office, the entire disclosures of which is incorporated herein by reference for all purposes.

BACKGROUND

1. Field

The following description relates to an antenna apparatus and an antenna module.

2. Description of Background

Mobile communications data traffic is rapidly increasing every year. Technological developments are being actively undertaken so as to support such rapidly increasing data in real time in a wireless network. For example, applications such as Internet of Things (IoT), augmented reality (AR), virtual reality (VR), live VR/AR combined with Social Network Services (SNS), autonomous driving, sync view (in which a real time image of a user point of view is transmitted using a ultra small camera), and the like, require communications (e.g., 5G communications, mmWave communications, etc.) for supporting the transmission and reception of large amounts of data.

Therefore, recently, millimeter wave (mmWave) communications including 5th (5G) communications have been actively researched, and research into the commercialization/standardization of an antenna module for smoothly implementing millimeter wave communications are also being actively performed.

Since radio frequency (RF) signals within high frequency bands (e.g., 24 GHz, 28 GHz, 36 GHz, 39 GHz, 60 GHz, and the like) are easily absorbed in a transmission process and lead to loss, quality of communications may be sharply deteriorated. Therefore, an antenna for communications of the high frequency bands requires a technical approach different from conventional antenna technology, and may require special technology developments such as a separate power amplifier for securing an antenna gain, integrating an antenna and radio frequency integrated circuits (RFIC), securing effective isotropic radiated power (EIRP), and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a ground layer having a through-hole; a feed via disposed to pass through the through-hole; a patch antenna pattern disposed on the ground layer and electrically connected to one end of the feed via; a first coupling patch pattern disposed on the patch antenna pattern; a second coupling patch pattern disposed between the first coupling patch pattern and the patch antenna pattern; and a dielectric layer disposed in at least of a portion a space between the first coupling patch pattern and the second coupling patch pattern so that a dielectric constant of at least a portion of a space between the patch antenna pattern and the second coupling patch pattern is lower than a dielectric constant of the space between the first coupling patch portion and the second coupling patch pattern.

The dielectric constant of at least a portion of the space between the patch antenna pattern and the second coupling patch pattern may be lower than a dielectric constant of the dielectric layer.

The dielectric layer may include a cavity disposed between the first coupling patch pattern and the patch antenna pattern.

The first coupling patch pattern may be disposed on the dielectric layer and may be exposed on one surface of the dielectric layer, and the second coupling patch pattern may be disposed in the cavity.

A lateral length of the first coupling patch pattern may be longer than a lateral length of the second coupling patch pattern, and the lateral length of the first coupling patch pattern may be shorter than a lateral length of the cavity.

A lateral length of the patch antenna pattern may be shorter than the lateral length of the second coupling patch pattern.

The antenna apparatus may include an upper dielectric layer disposed on the dielectric layer and surrounding the first coupling patch pattern.

The antenna apparatus may include electrical connection structures disposed on the ground layer to support the dielectric layer, and may include grounding vias to electrically connect the electrical connection structures to the ground layer.

The antenna apparatus may include a second dielectric layer disposed in at least a portion of a region between the ground layer and the patch antenna pattern, at least a portion of each of the grounding vias may be disposed in the second dielectric layer, and the electrical connection structures may be disposed on the second dielectric layer.

A dielectric constant of the second dielectric layer may be lower than a dielectric constant of the dielectric layer.

The antenna apparatus may include conductive array patterns arranged to surround the first coupling patch pattern or the second coupling patch pattern along a side boundary of the first coupling patch pattern or the second coupling patch pattern and may be electrically connected to the electrical connection structures.

The conductive array patterns may include first conductive array patterns disposed on a same level as the first coupling patch pattern, second conductive array patterns electrically connected to the grounding vias, and layout vias connecting the first conductive array patterns to the second conductive array patterns.

The antenna apparatus may include conductive array patterns arranged to surround the first coupling patch pattern or the second coupling patch pattern along a side boundary of the first coupling patch pattern or the second coupling patch pattern and comprising at least a portion disposed in the dielectric layer.

The conductive array patterns may include first and second conductive array patterns and layout vias connecting the first conductive array patterns to the second conductive array patterns.

In another general aspect, an antenna module includes a ground layer having through-holes; feed vias disposed to pass through the of through-holes, respectively; patch antenna patterns disposed on the ground layer and electrically connected to one end of the feed vias, respectively; first coupling patch patterns disposed on the patch antenna patterns; second coupling patch patterns disposed between the first coupling patch patterns and the patch antenna patterns; and a dielectric layer disposed in at least a portion of a space between the first coupling patch patterns and the second coupling patch patterns so that a dielectric constant of at least a portion of a space between the patch antenna patterns and the second coupling patch patterns is lower than a dielectric constant of the space between the first coupling patch patterns and the second coupling patch patterns.

The antenna module may include patch antenna feed lines disposed on an opposite side of the ground layer from the patch antenna patterns and electrically connected to the feed vias; an integrated circuit (IC) disposed on an opposite side of the patch antenna feed lines from the patch antenna patterns; and wiring vias to electrically connect the patch antenna feed lines to the IC.

In another general aspect, an antenna apparatus includes a ground layer; a patch antenna pattern disposed on the ground layer; a first coupling patch pattern disposed on the patch antenna pattern; a second coupling patch pattern disposed on the patch antenna pattern between the first coupling patch pattern and the patch antenna pattern; and a dielectric layer disposed between the first coupling patch pattern and the second coupling patch pattern.

The dielectric layer may include a cavity disposed between the first coupling patch pattern and the patch antenna pattern.

The second coupling patch pattern may be disposed in the cavity.

The antenna apparatus may be included in an electronic device.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
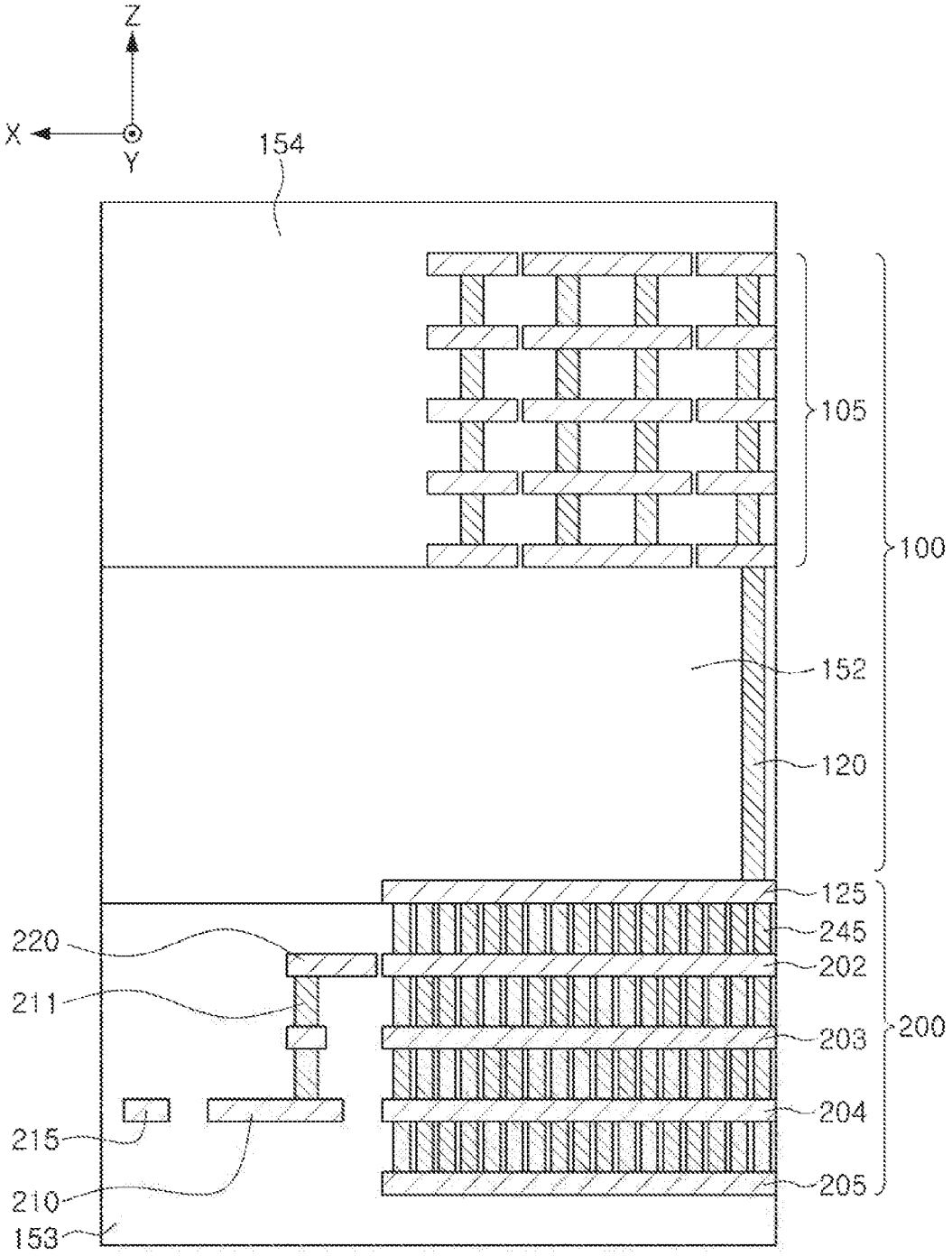
FIG. 1 is a side view schematically illustrating an antenna apparatus and an antenna module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Hereinafter, examples will be described in detail with reference to the accompanying drawings.

FIG. 1 is a side view schematically illustrating an antenna apparatus and an antenna module according to an example.

Referring to FIG. 1, an antenna apparatus 100 may be disposed on a connection member 200, and an antenna module may include a plurality of antenna apparatuses corresponding to the antenna apparatus 100. Depending on a design, the connection member 200 may be included in the antenna apparatus 100 and the antenna module. An integrated circuit (IC) may be disposed below the connection member 200.

The connection member 200 may be disposed on a third region 153, electrically connect the antenna apparatus 100 and the antenna module to the IC, and provide electromagnetic isolation and/or impedance between the antenna apparatus 100 and the antenna module and the IC.

The connection member 200 may provide an electrical ground to the antenna apparatus 100 and the antenna module and the IC, and may include at least portions of a ground layer 125, a second ground layer 202, a third ground layer 203, a fourth ground layer 204, a fifth ground layer 205, and a shielding via 245.

Depending on a design, the connection member 200 may include at least one end-fire antenna. The end-fire antenna may include at least portions of an end-fire antenna pattern 210, an end-fire antenna feed via 211, a director pattern 215, and an end-fire antenna feed line 220, and may transmit and receive a radio frequency (RF) signal in an X direction.

The antenna apparatus 100 and the antenna module may include an antenna package 105 and a feed via 120, and may transmit and receive the RF signal in a Z direction.

The antenna package 105 may be disposed on a first region 154, include a patch antenna pattern and first and second coupling patch patterns described below, and may further include a plurality of conductive array patterns.

The feed via 120 may be disposed on a second region 152 and may be electrically connected between the antenna package 105 and the connection member 200.

The antenna apparatus 100 and the antenna module may be advantageous for miniaturization as a dielectric constant of the first region 154 and the second region 152 becomes larger, and may be advantageous for improvement in an antenna performance (e.g., gain, bandwidth) as the dielectric constant of the first region 154 and the second region 152 becomes smaller.

The antenna apparatus 100 and the antenna module may provide a structure advantageous for miniaturization while having the improved antenna performance through the dielectric constant configuration of the first region 154 and the second region 152.

FIGS. 2A through 2J are side views illustrating an antenna apparatus and an antenna module according to examples.

Figure 2A:
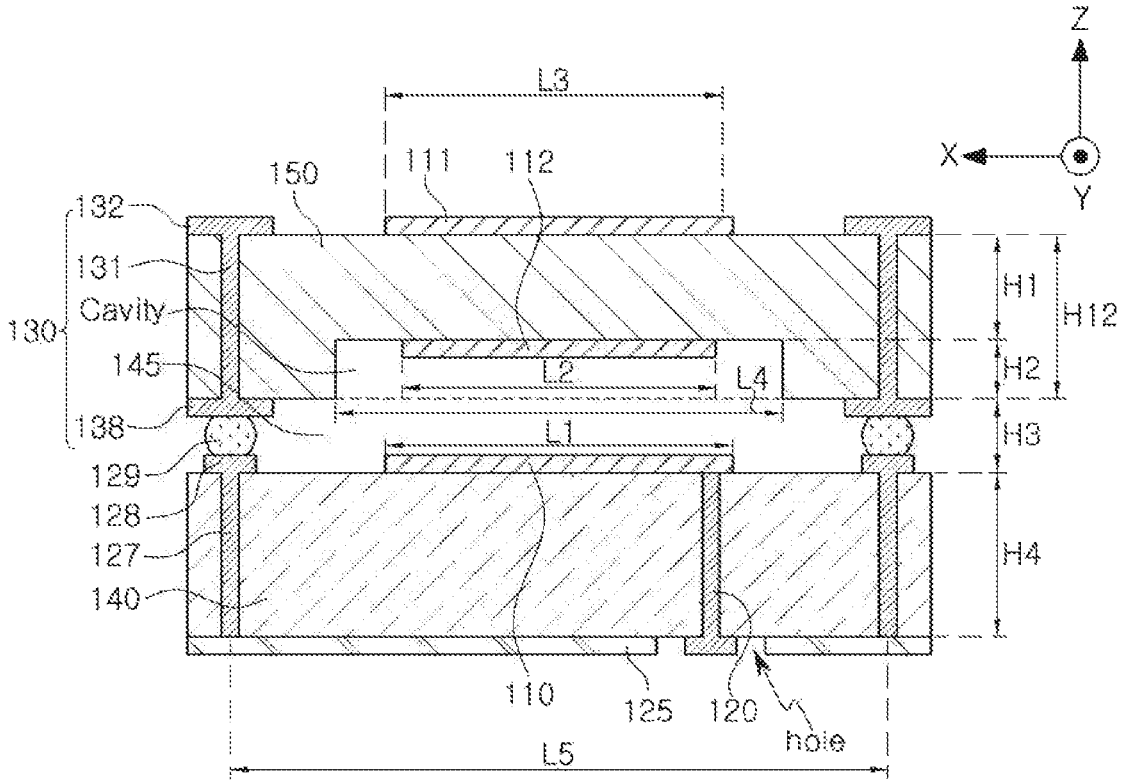
FIGS. 2A, 2B, 2C, 2D, 2E, 2F, 2G, 2H, 2I, and 2J are side views illustrating an antenna apparatus and an antenna module according to examples.

Referring to FIG. 2A, the antenna apparatus may include at least portions of a patch antenna pattern 110, a first coupling patch pattern 111, a second coupling patch pattern 112, a feed via 120, a ground layer 125, a grounding via 127, a pad 128, an electrical connection structure 129, a plurality of conductive array patterns 130, a second dielectric layer 140, a low dielectric region 145, and a dielectric layer 150.

Each of the dielectric layer 150 and the second dielectric layer 140 may provide a layout space of portions of the patch antenna pattern 110, the first coupling patch pattern 111, and the second coupling patch pattern 112. For example, the patch antenna pattern 110 may be disposed on an upper surface of the second dielectric layer 140 or disposed in the second dielectric layer 140. For example, the first coupling patch pattern 111 and the second coupling patch pattern 112 may be disposed on an upper surface or a lower surface of the dielectric layer 150 or disposed in the dielectric layer 150. For example, each of the dielectric layer 150 and the second dielectric layer 140 may have a form in which a plurality of layers is stacked. Each of the dielectric layer 150 and the second dielectric layer 140 may include a plurality of dielectric components depending on a viewpoint.

The ground layer 125 may improve electromagnetic isolation between the patch antenna pattern 110 and the connection member described above, and serve as a reflector for the patch antenna pattern 110 to reflect the RF signal of the patch antenna pattern 110 in the Z direction to further concentrate the RF signal in the Z direction. The ground layer 125 may be disposed to secure a spaced distance H4 from the patch antenna pattern 110 to have reflector characteristics.

The ground layer 125 may have a through-hole through which the feed via 120 passes. The through-hole may overlap the patch antenna pattern 110 when viewed in the Z direction.

The feed via 120 may transmit the RF signal received from the patch antenna pattern 110 to the connection member and/or the IC described above, and transmit the RF signal received from the connection member and/or the IC to the connection member and/or the IC described above. Depending on a design, a plurality of feed vias 120 may be connected to a single patch antenna pattern 110 or a plurality patch antenna patterns 110. In a case in which the plurality of feed vias 120 are connected to the single patch antenna pattern 110, each of the plurality of feed vias 120 may be configured so that a horizontal (H) pole RF signal and a vertical (V) pole RF signal, which are polarized waves with respect to each other, flow therethrough.

The patch antenna pattern 110 may be disposed at an upper side of the ground layer 125 and may be electrically connected to one end of the feed via 120. The patch antenna pattern 110 may receive the RF signal from the feed via 120 to remotely transmit the RF signal in the Z direction, or may remotely receive the RF signal in the Z direction to transmit the RF signal to the feed via 120.

The first coupling patch pattern 111 may be disposed at an upper side of the patch antenna pattern 110. The first coupling patch pattern 111 may be electromagnetically coupled to the patch antenna pattern 110, and may affect a resonance frequency of the patch antenna pattern 110 and further concentrate the RF signal in the Z direction to improve a gain of the patch antenna pattern 110.

A wavelength of the RF signal transmitting between the patch antenna pattern 110 and the first coupling patch pattern 111 may be longer as an effective dielectric constant between the patch antenna pattern 110 and the first coupling patch pattern 111 becomes smaller. A concentration of the RF signal in the Z direction according to an electromagnetic coupling between the patch antenna pattern 110 and the first coupling patch pattern 111 may be greater as the wavelength of the RF signal becomes longer. Therefore, the gain of the patch antenna pattern 110 may be improved as the effective dielectric constant between the patch antenna pattern 110 and the first coupling patch pattern 111 becomes smaller.

In a case in which the effective dielectric constant between the patch antenna pattern 110 and the first coupling patch pattern 111 becomes smaller, a size of the patch antenna pattern 110 for maintaining the resonance frequency may become larger and a bandwidth of the patch antenna pattern 110 may become narrower.

Therefore, the antenna apparatus and the antenna module may further include the second coupling patch pattern 112 disposed between the patch antenna pattern 110 and the first coupling patch pattern 111, thereby lowering the resonance frequency of the patch antenna pattern 110 and widening the bandwidth of the patch antenna pattern 110.

The second coupling patch pattern 112 may be disposed between the first coupling patch pattern 111 and the patch antenna pattern 110. The second coupling patch pattern 112 may be disposed so that the effective dielectric constant between the first coupling patch pattern 111 and the second coupling patch pattern 112 is greater than the effective dielectric constant between the second coupling patch pattern 112 and the patch antenna pattern 110. Accordingly, the patch antenna pattern 110 may more easily offset a resonance frequency shift and a bandwidth reduction according to a reduction in the effective dielectric constant between the patch antenna pattern 110 and the first coupling patch pattern 111.

The dielectric layer 150 may occupy at least a portion of a space between the first coupling patch pattern 111 and the second coupling patch pattern 112 and may be disposed so that the dielectric constant DK of at least a portion of a space between the patch antenna pattern 110 and the second coupling patch pattern 112 is lower than the dielectric constant DK of the space between the first coupling patch pattern 111 and the second coupling patch pattern 112.

The effective dielectric constant between the first coupling patch pattern 111 and the second coupling patch pattern 112 and the effective dielectric constant between the second coupling patch pattern 112 and the patch antenna pattern 110 may be determined according to a layout position of the dielectric layer 150.

For example, the dielectric constant of at least a portion of the space between the patch antenna pattern 110 and the second coupling patch pattern 112 may be lower than the dielectric constant of the dielectric layer 150. The space between the patch antenna pattern 110 and the second coupling patch pattern 112 may include the low dielectric region 145. For example, the low dielectric region 145 may have the same dielectric constant as air, but include a dielectric material or an encapsulant having a dielectric constant smaller than that of the dielectric layer 150 according to the design to thereby secure insulation reliability.

For example, the dielectric layer 150 may provide a cavity in a downward direction (Z direction). The cavity may lower the effective dielectric constant without increasing a physical distance between the patch antenna pattern 110 and the first and second coupling patch patterns 111 and 112 or increasing a length H12 of the dielectric layer 150 in the Z direction. Therefore, the size of the antenna device and antenna module may be further reduced compared to the antenna performance.

For example, the first coupling patch pattern 111 may be disposed on the dielectric layer 150 and may be disposed to be exposed to an upper side of the dielectric layer 150, and the second coupling patch pattern 112 may be disposed in the cavity of the dielectric layer 150. For example, a distance between the second coupling patch pattern 112 and the patch antenna pattern 110 may be increased from H3 to (H2+H3), and a distance between the second coupling patch pattern 112 and the first coupling patch pattern 111 may be shortened from H12 to H1. The antenna apparatus and the antenna module may more efficiently use the characteristics of the low dielectric constant advantageous for the antenna performance and may more efficiently use the characteristics of the high dielectric constant advantageous for miniaturization.

For example, a lateral length L3 of the first coupling patch pattern 111 may be longer than a lateral length L2 of the second coupling patch pattern 112, and the lateral length L3 of the first coupling patch pattern 111 may be shorter than a lateral length L4 of the cavity of the dielectric layer 150. Accordingly, the second coupling patch pattern 112 may improve the gain and widen the bandwidth by efficiently utilizing a boundary of the cavity.

For example, a lateral length L1 of the patch antenna pattern 110 may be shorter than the lateral length L2 of the second coupling patch pattern 112. Accordingly, the second coupling patch pattern 112 may be more easily coupled to the patch antenna pattern 110, and the bandwidth of the patch antenna pattern 110 may be further widened.

The cavity may be omitted. The antenna apparatus and the antenna module may be implemented by omitting the filling of a dielectric material and filling a dielectric material having a low dielectric constant even though the cavity is not present, and may be implemented by an electrical bonding in a state in which the dielectric layer 150 and the second dielectric layer 140 are separately manufactured.

The second dielectric layer 140 may be disposed to occupy at least a portion of a region between the ground layer 125 and the patch antenna pattern 110.

A plurality of electrical connection structures 129 may be disposed on the ground layer 125 and support the dielectric layer 150. Each of the plurality of electrical connection structures 129 may have a predetermined height to thereby provide the low dielectric region 145.

Since the low dielectric region 145 may secure insulation reliability without a separate insulating material, the low dielectric region 145 may be formed of air. The air may have the dielectric constant of substantially one and may not require a separate process to be filled in the low dielectric region 145. Therefore, the effective dielectric constant between the patch antenna pattern 110 disposed on the second dielectric layer 140 and the second coupling patch pattern 112 disposed on the dielectric layer 150 may be easily lowered.

The plurality of electrical connection structures 129 may electrically connect a conductive component (e.g., the conductive array pattern) disposed on the dielectric layer 150 and a conductive component (e.g., the ground layer) disposed on the second dielectric layer 140 to each other, and have a melting point lower than that of the conductive components, thereby providing an electrical bonding environment in the state in which the dielectric layer 150 and the second dielectric layer 140 are separately manufactured.

The antenna apparatus and the antenna module may increase the size and/or height of the plurality of electrical connection structures 129 even though the antenna apparatus and the antenna module do not have the cavity, thereby further lowering the effective dielectric constant between the patch antenna pattern 110 and the second coupling patch 112. For example, the plurality of electrical connection structures 129 may be designed to be larger than the electrical connection structure between the IC and the connection member. For example, the plurality of electrical connection structures 129 may be selected from structures such as solder balls, pins, pads, lands, or sub-boards, and may have a different structure from the electrical connection structure between the IC and the connection member to thereby increase the size and/or height.

The dielectric constant of the second dielectric layer 140 may be lower than the dielectric constant of the dielectric layer 150. The size of the patch antenna pattern 110 and the first and second coupling patch patterns 111 and 112 for maintaining the resonance frequency may be smaller as the dielectric constant of the dielectric layer 150 becomes larger. A spaced distance between the patch antenna pattern 110 and an adjacent antenna apparatus may be smaller as the dielectric constant of the dielectric layer 150 becomes larger. The antenna apparatus and the antenna module may improve the antenna performance by providing the low dielectric region 145 while implementing the miniaturization by using the dielectric layer 150 having the larger dielectric constant.

For example, the dielectric layer 150 may have a dielectric dissipation factor (DF) smaller than that of the second dielectric layer 140. Accordingly, energy loss due to the RF signal transmission and reception of the patch antenna pattern 110 may be reduced.

A plurality of conductive array patterns 130 may have a predetermined lateral length L5 to be disposed to surround the first coupling patch pattern 111 or the second coupling patch pattern 112 along a side boundary of the first coupling patch pattern 111 or the second coupling patch pattern 112, and may be electrically connected to the plurality of electrical connection structures 129. The dielectric layer 150 may provide a layout space of the plurality of conductive array patterns 130. The plurality of conductive array patterns 130 may be electromagnetically coupled to the first coupling patch pattern 111 or the second coupling patch pattern 112, and may improve electromagnetic isolation between the patch antenna pattern 110 and the adjacent antenna apparatus.

For example, the plurality of conductive array patterns 130 may include a plurality of first conductive array patterns 132 disposed on the same level as the first coupling patch pattern 111, a plurality of second conductive array patterns 138 electrically connected to a plurality of grounding vias 127, and a plurality of layout vias 131 connecting the plurality of first conductive array patterns 132 and the plurality of second conductive array patterns 138 to each other. Accordingly, since the plurality of conductive array patterns 130 may be similar to an electromagnetic bandgap structure, the transmitted RF signal may be further induced in the Z direction.

For example, the plurality of conductive array patterns 130 may be electrically connected to the ground layer 125 through the plurality of grounding vias 127 and the pad 128. At least a portion of each of the plurality of grounding vias 127 may be disposed in the second dielectric layer 140. Accordingly, an electromagnetic shielding performance of the plurality of conductive array patterns 130 may be further improved.

Figure 2B:
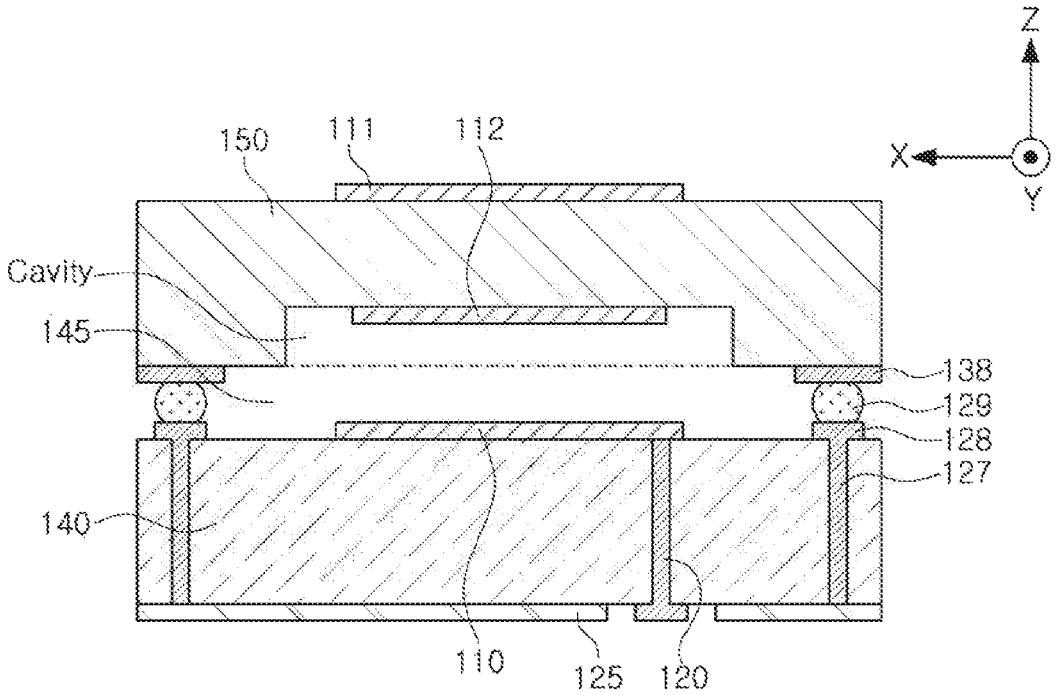

FIG. 2B is a view illustrating a structure in which the plurality of conductive array patterns is omitted as compared to the antenna apparatus of FIG. 2A. That is, the antenna apparatus may not include the plurality of conductive array patterns described above.

As compared to the antenna apparatus illustrated in FIG. 2A, the antenna apparatus illustrated in FIG. 2B may have an improved antenna performance as the number of patch antenna patterns 110 is smaller, and may have the improved antenna performance as an interval between the patch antenna pattern 110 and adjacent antenna patterns is longer. Therefore, whether or not the plurality of conductive array patterns is included may vary depending on the number and/or interval of the patch antenna patterns 110.

For example, an interval between the patch antenna pattern 110 and the second coupling patch pattern 112 may be about 0.2 mm, an interval between the second coupling patch pattern 112 and the first coupling patch pattern 111 may be about 0.2 mm, a height of the cavity in the Z direction may be about 0.1 mm, a height of the first coupling patch pattern 111 and the second coupling patch pattern 112 in the Z direction may each be about 0.015 mm, and a distance between the patch antenna pattern 110 and the ground layer 125 may be about 0.3 mm.

Figure 2C:
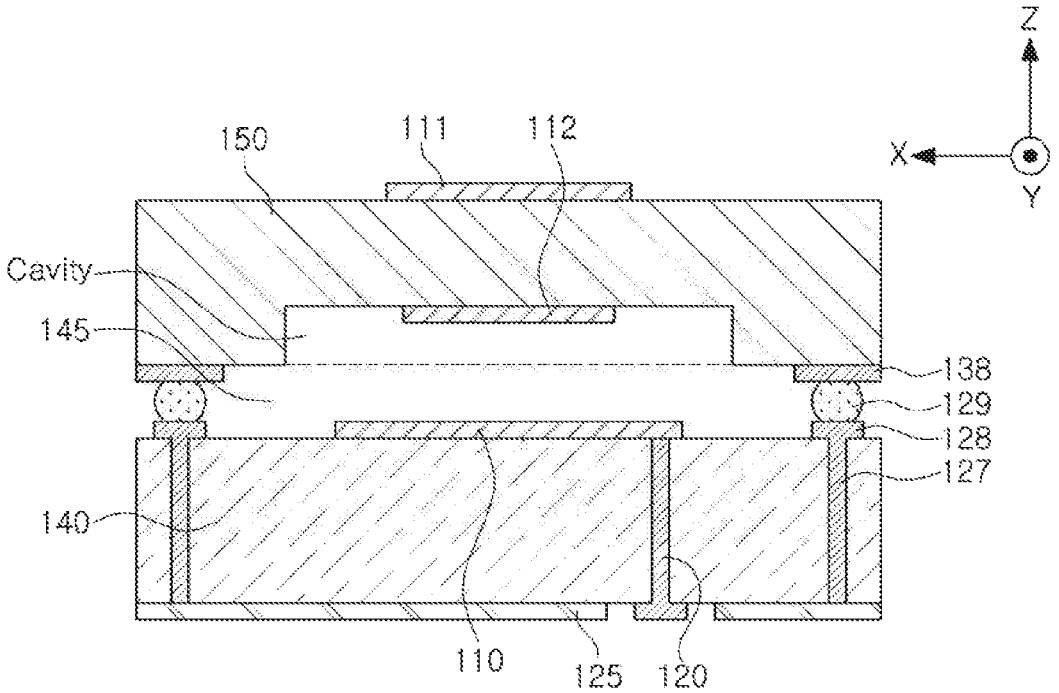

FIG. 2C is a view illustrating a structure in which the size of the first and second coupling patch patterns is reduced as compared to the antenna apparatus of FIG. 2B.

Referring to FIG. 2C, the dielectric layer 150 may have a dielectric constant greater than that of the second dielectric layer 140, and may have a dielectric constant greater than that of the dielectric layer illustrated in FIGS. 2A and 2B. Accordingly, as compared to the antenna apparatus illustrated in FIG. 2B, the antenna apparatus illustrated in FIG. 2C may have the first and second coupling patch patterns 111 and 112 which are further miniaturized.

For example, a length of the patch antenna pattern 110 in a horizontal direction may be about 2.5 mm, a length of the first coupling patch pattern 111 in the horizontal direction may be about 2.1 mm, and a length of the second coupling patch pattern 112 in the horizontal direction may be about 1.7 mm.

Figure 2D:
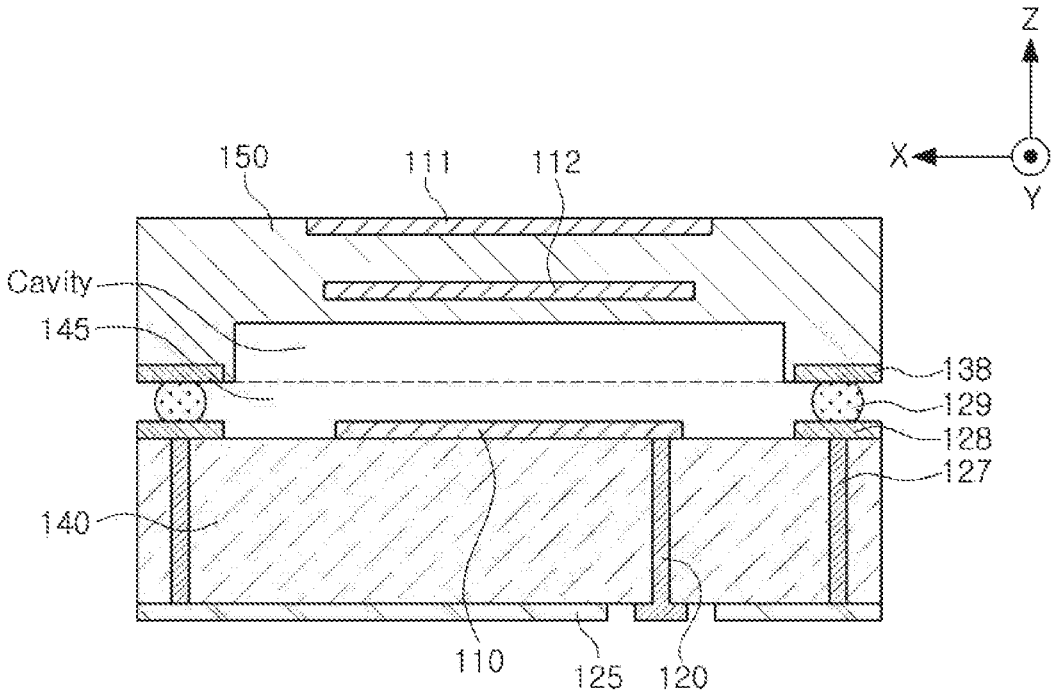

FIG. 2D is a view illustrating a structure in which the dielectric constant of the dielectric layer is reduced as compared to the antenna apparatus of FIG. 2C.

Referring to FIG. 2D, the dielectric layer 150 may have a substantially same dielectric constant as that of the second dielectric layer 140, and may have a dielectric constant smaller than that of the dielectric layer illustrated in FIGS. 2A and 2B.

Accordingly, as compared to the antenna apparatus illustrated in FIG. 2C, an interval between the first coupling patch pattern 111 and the second coupling patch pattern 112 may be further shortened and may be shorter than an interval between the second coupling patch pattern 112 and the patch antenna pattern 110.

As compared to the antenna apparatus illustrated in FIG. 2C, the lateral length of the cavity may be longer.

For example, the interval between the patch antenna pattern 110 and the second coupling patch pattern 112 may be about 0.28 mm, the interval between the second coupling patch pattern 112 and the first coupling patch pattern 111 may be about 0.12 mm, a height of the electrical connection structure 129 may be about 0.1 mm, the length of the patch antenna pattern 110 in the horizontal direction may be about 2.5 mm, the length of the first coupling patch pattern 111 in the horizontal direction may be about 2.7 mm, and the length of the second coupling patch pattern 112 in the horizontal direction may be about 1.5 mm.

Figure 2E:
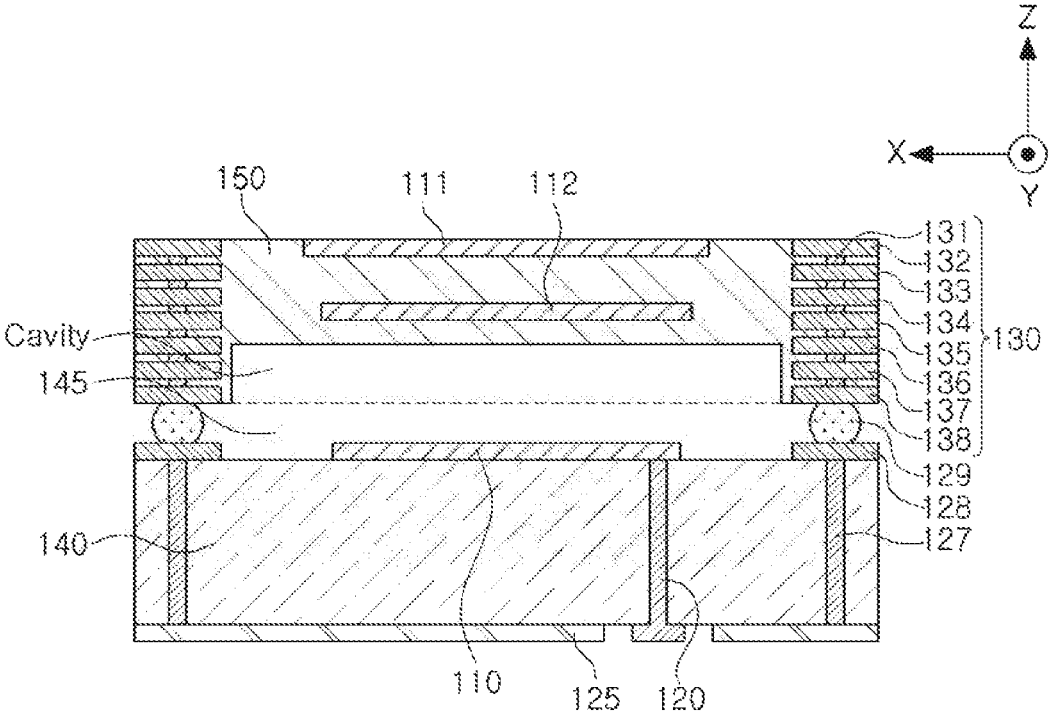

FIG. 2E is a view illustrating a structure in which the plurality of conductive array patterns is additionally disposed as compared to the antenna apparatus of FIG. 2D.

Referring to FIG. 2E, the dielectric layer 150 may include the plurality of layout vias 131, the plurality of first conductive array patterns 132, the plurality of second conductive array patterns 138, a plurality of third conductive array patterns 133, a plurality of fourth conductive array patterns 134, a plurality of fifth conductive array patterns 135, a plurality of sixth conductive array patterns 136, and a plurality of seventh conductive array patterns 137.

As compared to the antenna apparatus illustrated in FIG. 2D, the antenna apparatus illustrated in FIG. 2E may have an improved antenna performance as the number of patch antenna patterns 110 becomes greater, and may have the improved antenna performance as the interval between the patch antenna pattern 110 and adjacent antenna patterns becomes shorter. For example, the interval the patch antenna pattern 110 and adjacent antenna patterns may be longer than a half of the wavelength of the RF signal.

Figure 2F:
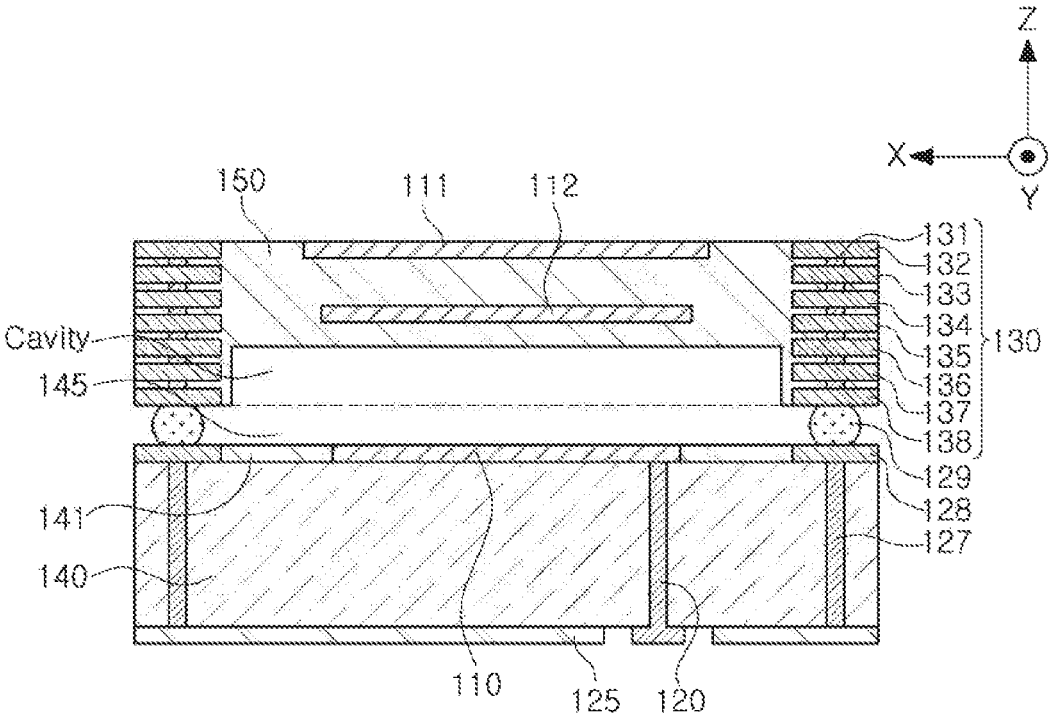

FIG. 2F is a view illustrating a structure in which a second upper dielectric layer of the antenna pattern is additionally disposed as compared to the antenna apparatus of FIG. 2E.

Referring to FIG. 2F, the second dielectric layer 140 may further include a second upper dielectric layer 141 surrounding a side surface of the patch antenna pattern 110. The second upper dielectric layer 141 may improve durability of the patch antenna pattern 110.

Figure 2G:
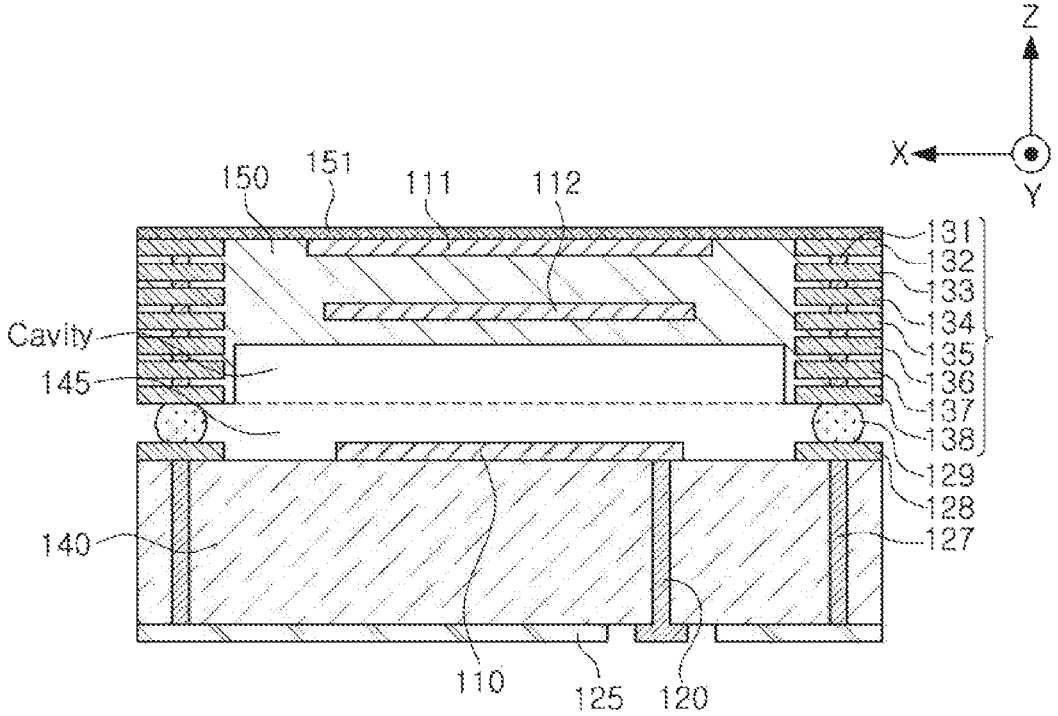

FIG. 2G is a view illustrating a structure in which an upper dielectric layer of the dielectric layer is additionally disposed as compared to the antenna apparatus of FIG. 2E.

Referring to FIG. 2G, the dielectric layer 150 may further include an upper dielectric layer 151 disposed on the dielectric layer 150. The upper dielectric layer 151 may improve durability of the first coupling patch pattern 111.

Figure 2H:
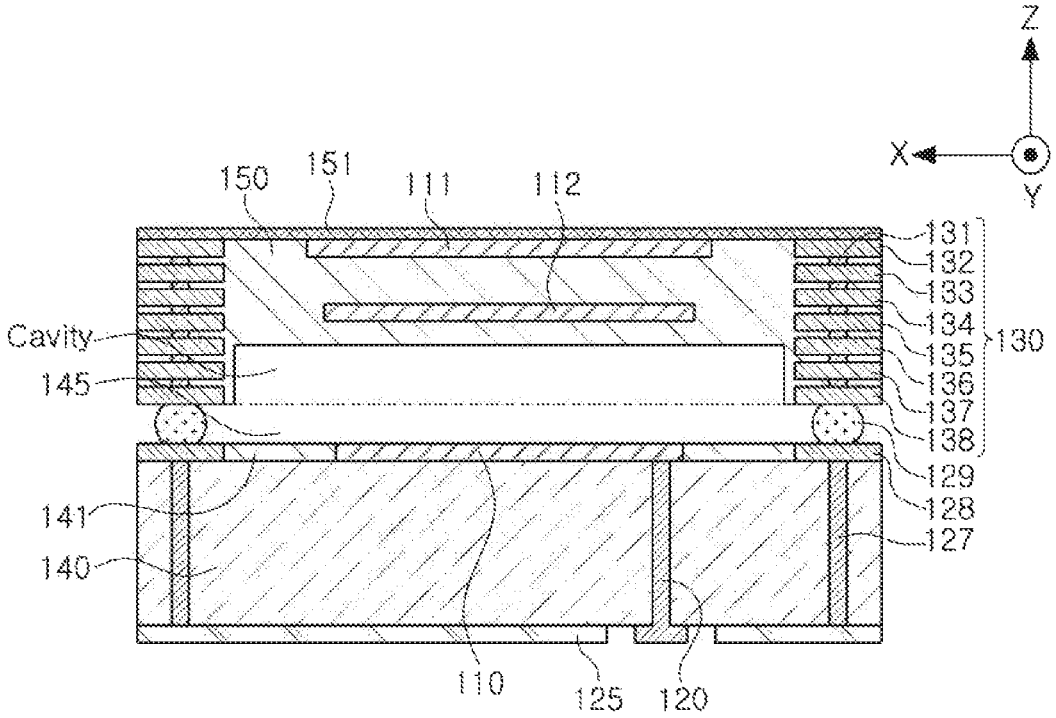

FIG. 2H is a view illustrating a structure in which a second upper dielectric layer of the patch antenna pattern is additionally disposed as compared to the antenna apparatus of FIG. 2G.

Referring to FIG. 2H, the second dielectric layer 140 may further include a second upper dielectric layer 141 surrounding a side surface of the patch antenna pattern 110, and the dielectric layer 150 may further include an upper dielectric layer 151 disposed on the first coupling patch pattern 111.

Figure 2I:
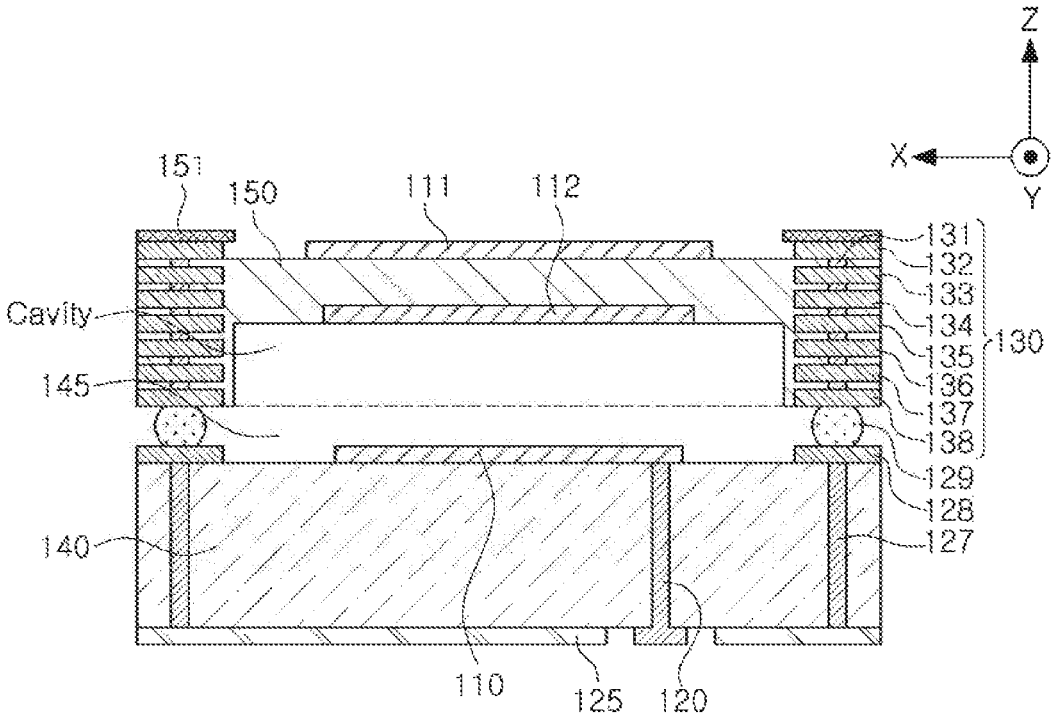

FIG. 2I is a view illustrating a structure in which the size of the cavity is increased as compared to the antenna apparatus of FIG. 2E.

Referring to FIG. 2I, the dielectric layer 150 may include a cavity having a relatively long height (in the Z direction). Accordingly, since the effective dielectric constant of the antenna apparatus may be further reduced, the gain of the antenna apparatus may be further improved.

For example, the height of the cavity may be about 0.18 mm, and the distance between the first coupling patch pattern 111 and the second coupling patch pattern 112 may be about 0.1 mm.

Figure 2J:
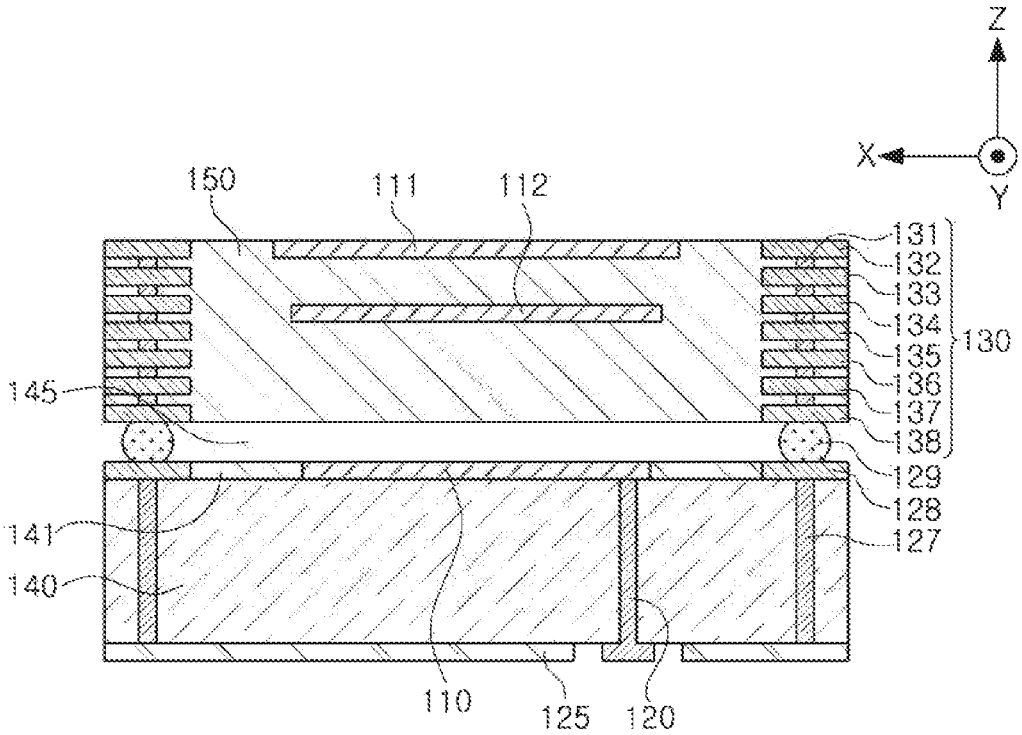

FIG. 2J is a view illustrating a structure in which the cavity is omitted as compared to the antenna apparatus of FIG. 2E.

Referring to FIG. 2J, the dielectric layer 150 may not include the cavity. Accordingly, the bandwidth of the antenna apparatus may be further widened.

For example, the height of the electrical connection structure 129 may be about 0.1 mm.

Figure 3A:
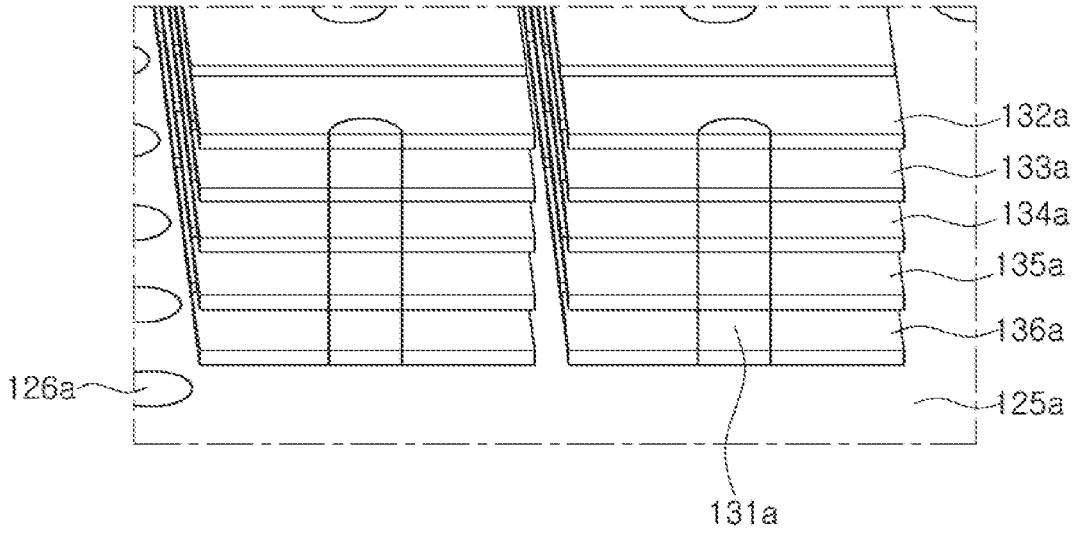
FIGS. 3A, 3B, and 3C are views illustrating a plurality of conductive array patterns that may be included an antenna apparatus and an antenna module according to various examples.
Figure 3B:
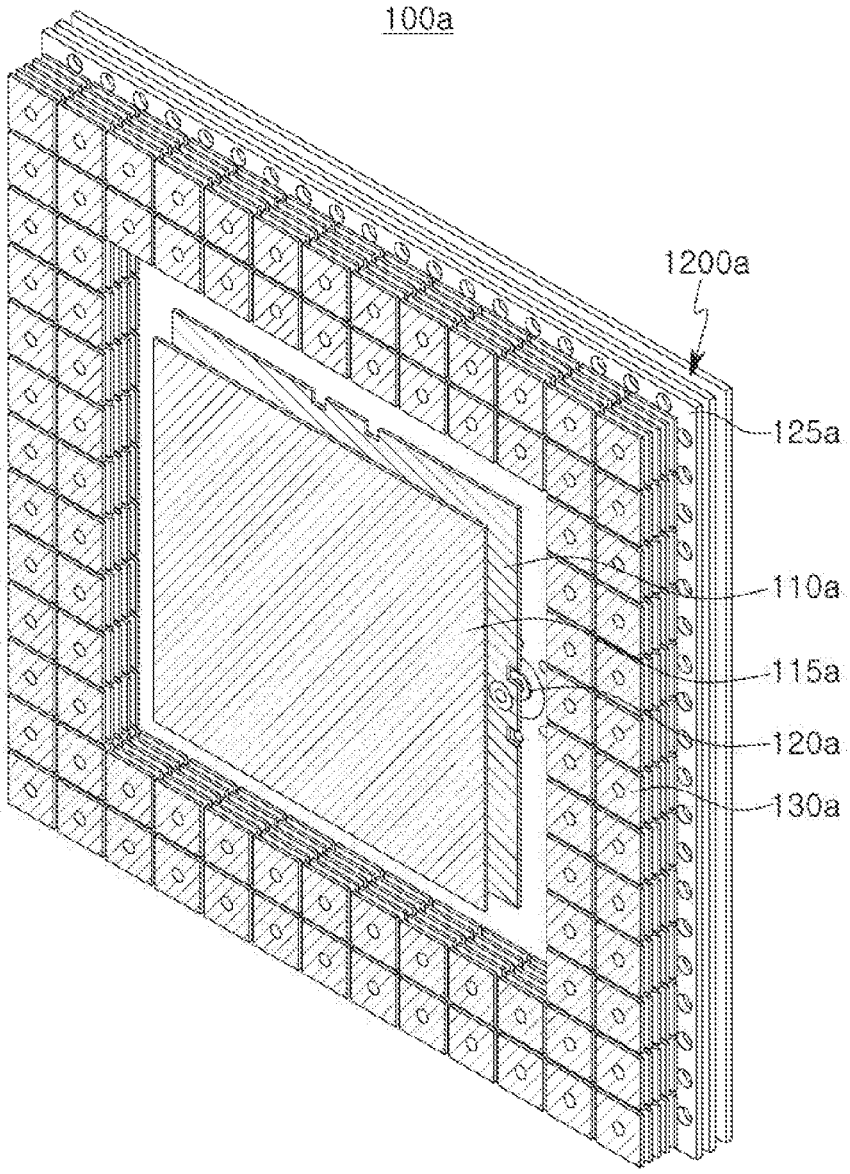
Figure 3C:
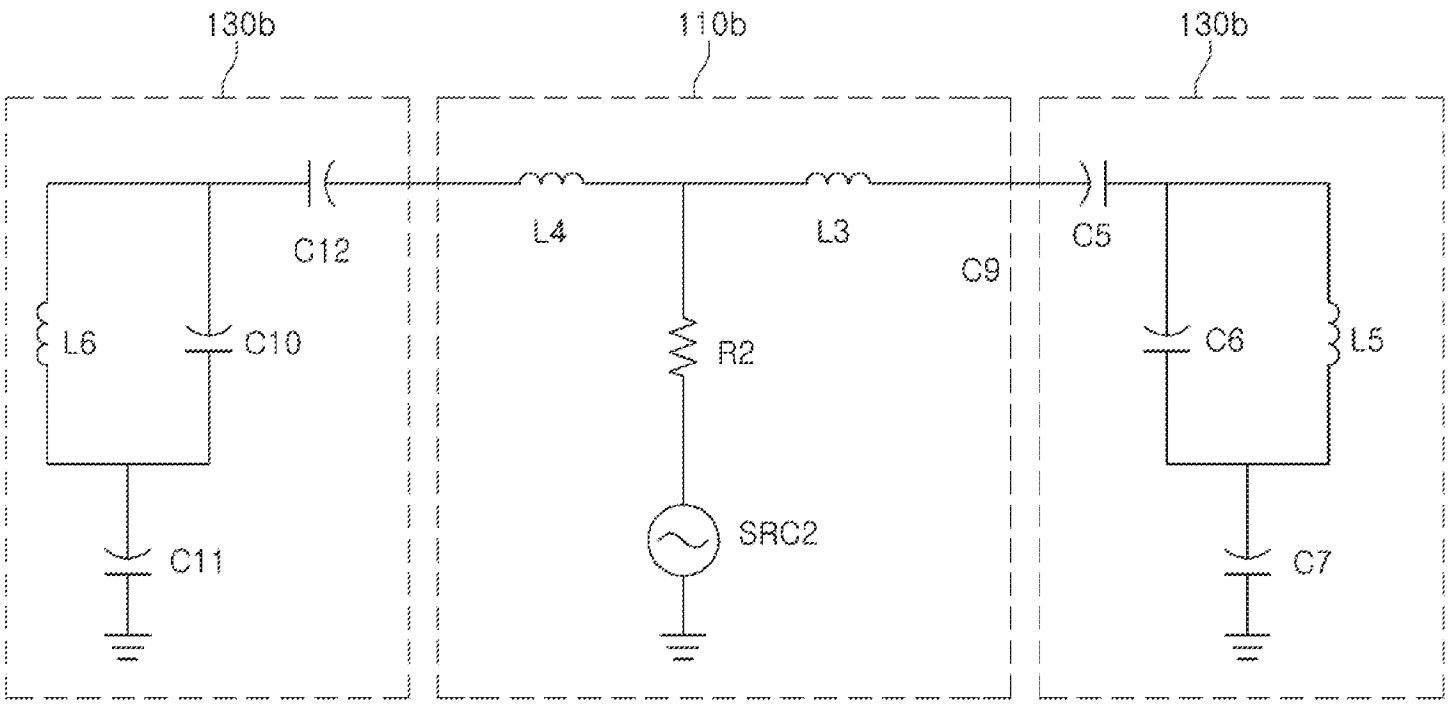

FIGS. 3A through 3C are views illustrating a plurality of conductive array patterns that may be included in the antenna apparatus and the antenna module according to the examples.

Referring to FIG. 3A and FIG. 3B, a plurality of conductive array patterns 130*a* may include a plurality of layout vias 131*a*, a plurality of first conductive patterns 132*a*, a third conductive array pattern 133*a*, a fourth conductive array pattern 134*a*, a fifth conductive array pattern 135*a*, and a sixth conductive array pattern 136*a*, and may be disposed on a ground layer 125*a* including a shielding via 126*a*.

For example, the plurality of conductive array patterns 130*a* may be arranged in a structure of n×2. Here, n is a natural number of 2 or more. That is, the plurality of conductive array patterns 130*a* may be arranged in two strings. The RF signal leaked in the X direction or the Y direction in the patch antenna pattern may be transmitted as if it is incident on a medium having a negative refractive index due to a narrow gap between a string that is closer to the patch antenna pattern and a string that is farther from the patch antenna pattern among the two strings. Therefore, the plurality of conductive array patterns 130*a* arranged in the structure of n×2 may further concentrate the RF signal in the Z direction. The structure of the plurality of conductive array patterns 130*a* is not limited to the structure of n×2, but may be varied according to the design. For example, the plurality of conductive array patterns 130*a* may be arranged in a structure of n×1.

Referring to FIG. 3B, an antenna apparatus 100*a* may include the plurality of conductive array patterns 130*a* disposed to surround a patch antenna pattern 110*a* and a coupling patch pattern 115*a* along side boundaries of the patch antenna pattern 110*a* and the coupling patch pattern 115*a*. Accordingly, the plurality of conductive array patterns 130*a* may more efficiently induce the RF signal in the Z direction.

A feed via 120*a* may be connected to the patch antenna pattern 110*a* and may be disposed to penetrate through a ground layer 125*a*. The ground layer 125*a* may be included in a connection member 1200*a*.

Referring to FIG. 3C, a patch antenna pattern 110*b* of the antenna apparatus may transmit the RF signal to a source SRC2 such as the IC or receive the RF signal from the source SRC2, and may have a resistance value R2 and inductances L3 and L4.

A plurality of conductive array patterns 130*b* may have capacitances C5 and C12 for a patch antenna pattern 110*b*, capacitances C6 and C10 between the plurality of conductive array patterns, inductances L5 and L6 of a layout via, and capacitances C7 and C11 between the plurality of conductive array patterns and a ground layer.

A frequency band and a bandwidth of the antenna apparatus may be determined by the resistance value, the capacitances, and inductances described above.

Figure 4A:
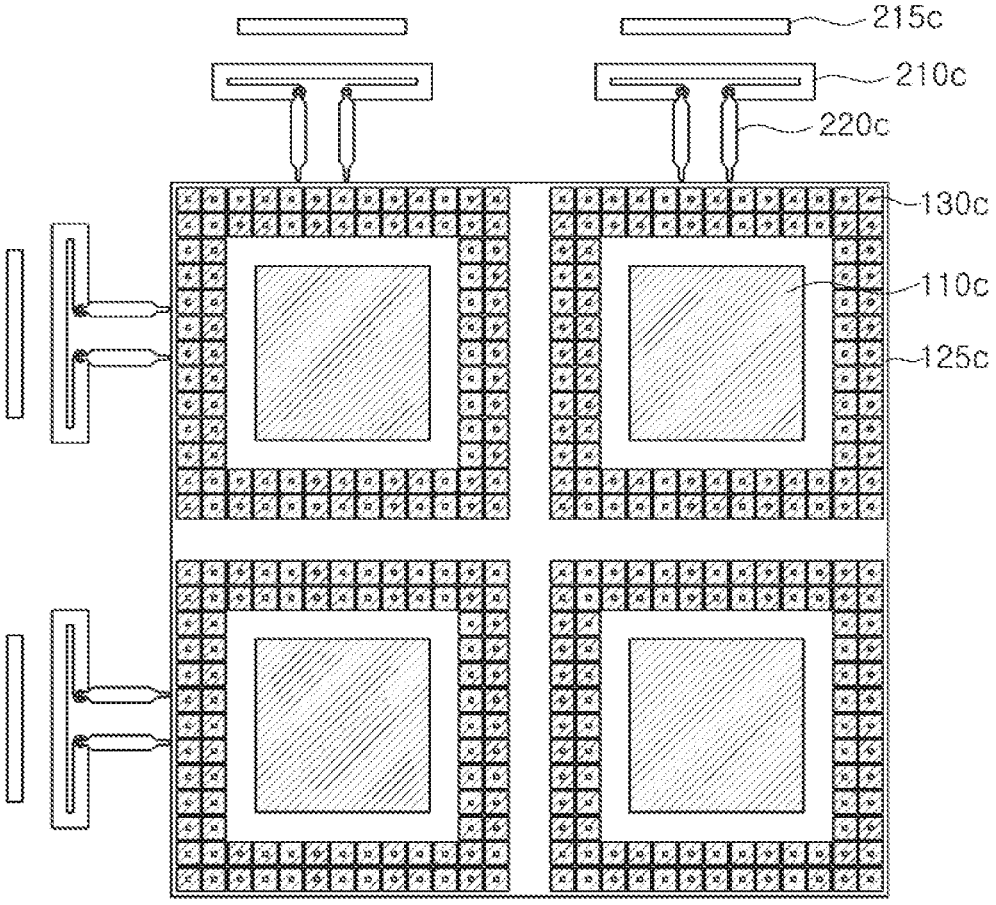
FIGS. 4A, 4B, and 4C are plan views illustrating an antenna apparatus and an antenna module according to examples.
Figure 4B:
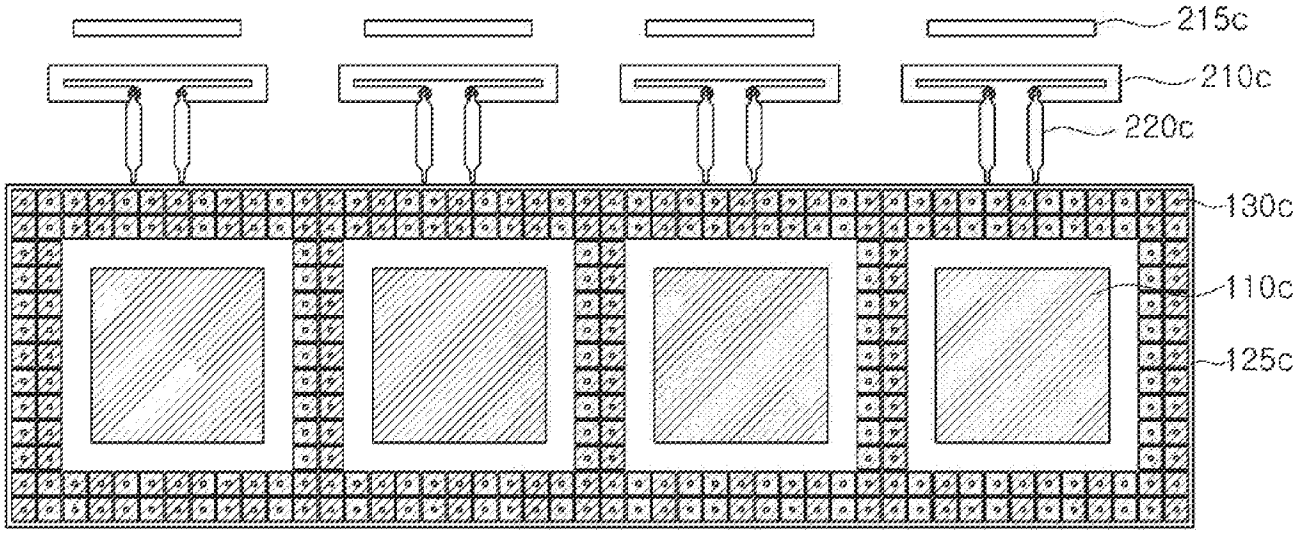
Figure 4C:
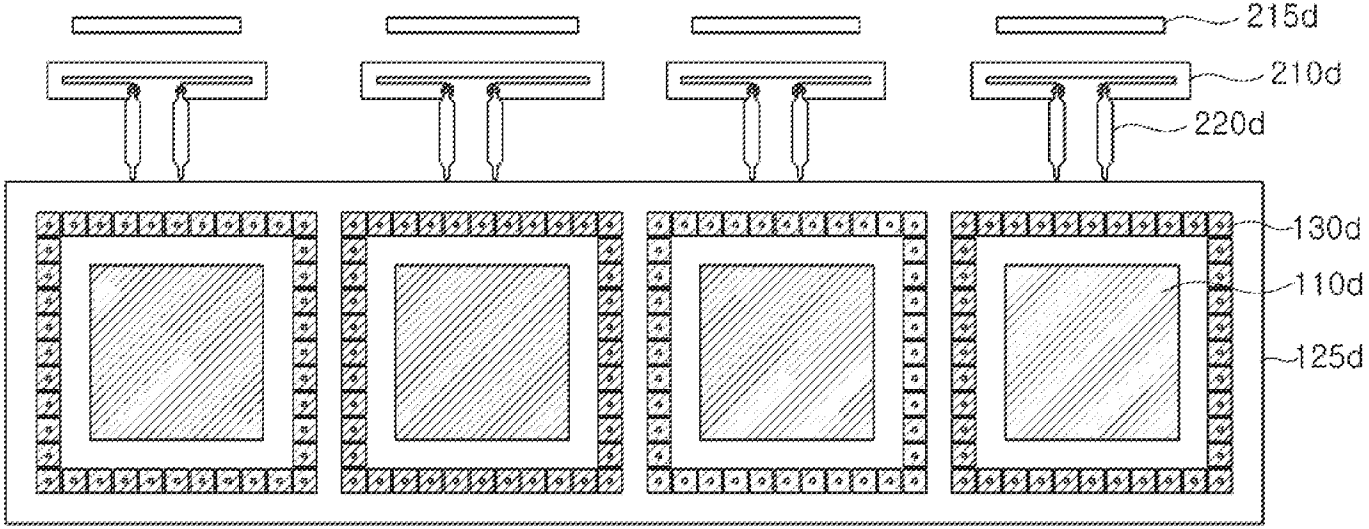

FIGS. 4A through 4C are plan views illustrating an antenna apparatus and an antenna module according to examples.

Referring to FIGS. 4A and 4B, an antenna module may include at least portions of a plurality of patch antenna patterns 110*c*, a ground layer 125*c*, a plurality of conductive array patterns 130*c*, a plurality of end-fire antenna patterns 210*c*, a plurality of director patterns 215*c*, and a plurality of end-fire feed lines 220*c*.

A plurality of end-fire antenna patterns 210*c* may form a radial pattern in a second direction to transmit or receive the RF signal in the second direction (e.g., the lateral direction). For example, the plurality of end-fire antenna patterns 210*c* may be disposed in the connection member to be adjacent to a side surface of the connection member, and may have a dipole shape or a folded dipole shape. One end of a pole of each of the plurality of end-fire antenna patterns 210*c* may be electrically connected to first and second lines of the plurality of end-fire antenna feed lines 220*c*. A frequency band of the plurality of end-fire antenna patterns 210*c* may be designed to be the substantially same as that of the plurality of patch antenna patterns 110*c*, but is not limited to such a frequency band.

A plurality of director patterns 215*c* may be electromagnetically coupled to the plurality of end-fire antenna patterns 210*c* to improve a gain or a bandwidth of the plurality of end-fire antenna patterns 210*c*.

The plurality of end-fire antenna feed lines 220*c* may transmit the RF signal received from the plurality of end-fire antenna patterns 210*c* to the IC, and may transmit the RF signal received from the IC to the plurality of end-fire antenna patterns 210*c*. The plurality of end-fire antenna feed lines 220*c* may be implemented as wirings of the connection member.

Since the antenna module may form the radial patterns in the first and second directions, a transmission and reception direction of the RF signal may be expanded omni-directionally.

The antenna apparatus may be arranged in a structure of n x m as illustrated in FIG. 4A, and the antenna module including the antenna apparatus may be disposed to be adjacent to a vertex of an electronic device.

The antenna apparatus may be arranged in a structure of n×1 as illustrated in FIG. 4B, and the antenna module including the antenna apparatus may be disposed to be adjacent to an intermediate point of an edge of the electronic device.

Referring to FIG. 4C, an antenna module according may include at least portions of a plurality of patch antenna patterns 110*d*, a ground layer 125*d*, a plurality of conductive array patterns 130*d*, a plurality of end-fire antenna patterns 210*d*, a plurality of director patterns 215*d*, and a plurality of end-fire feed lines 220*d*.

The plurality of conductive array patterns 130*d* may be arranged in a structure of n×1, may be disposed to surround each of the plurality of patch antenna patterns 110*d*, and may be disposed to be spaced apart from each other. Accordingly, an influence of a plurality of antenna apparatuses on each other may be reduced.

FIGS. 5A through 5F are views illustrating connection members that may be included in the antenna apparatus and the antenna module according to the examples.

Figure 5A:
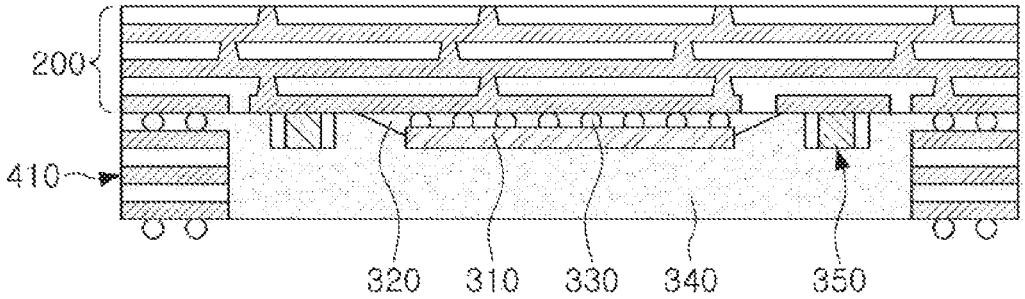
FIGS. 5A, 5B, 5C, 5D, 5E, and 5F are views illustrating connection members that may be included in an antenna apparatus and an antenna module according to various examples.

Referring to FIG. 5A, the antenna module may include at least portions of a connection member 200, an IC 310, adhesive members 320, electrical connection structures 330, an encapsulant 340, passive components 350, and sub-boards 410.

The connection member 200 may have a structure similar to the connection member described above with reference to FIGS. 1 through 4C.

The IC 310 may be the same as the IC described above and may be disposed below the connection member 200. The IC 310 may be electrically connected to a wiring of the connection member 200 to transmit or receive the RF signal, and may be electrically connected to a ground layer of the connection member 200 to be provided with a ground. For example, the IC 310 may perform at least a portion of frequency conversion, amplification, filtering, phase control, and power generation to generate a converted signal.

The adhesive member 320 may bond the IC 310 and the connection member 200 to each other.

The electrical connection structures 330 may electrically connect the IC 310 and the connection member 200 to each other. For example, the electrical connection structures 330 may have a structure such as a solder ball, a pin, a land, and a pad. The electrical connection structures 330 may have a melting point lower than that of the wiring of the connection member 200 and the ground layer to electrically connect the IC 310 and the connection member 200 to each other through a predetermined process using the low melting point.

The encapsulant 340 may encapsulate at least a portion of the IC and may improve a heat radiation performance and a shock protection performance of the IC 310. For example, the encapsulant 340 may be formed of a photo imageable encapsulant (PIE), Ajinomoto build-up film (ABF), epoxy molding compound (EMC), or the like.

The passive component 350 may be disposed on a lower surface of the connection member 200, and may be electrically connected to the wiring of the connection member 200 and/or the ground layer through the electrical connection structures 330. For example, the passive component 350 may include at least a portion of a capacitor (e.g., a multilayer ceramic capacitor (MLCC)), an inductor, and a chip resistor.

The sub-board 410 may be disposed below the connection member 200, and may be electrically connected to the connection member 200 to receive an intermediate frequency (IF) signal or a base band signal from the outside and to transmit the IF signal or the base signal to the IC 310, or to receive the IF signal or the base band signal from the IC 310 and transmit the IF signal or the base signal to the outside. Here, frequencies (e.g., 24 GHz, 28 GHz, 36 GHz, 39 GHz, and 60 GHz) of the RF signal may be greater than those (e.g., 2 GHz, 5 GHz, 10 GHz, and the like) of the IF signal.

For example, the sub-board 410 may transmit or receive the IF signal or the base band signal to the IC 310 or from the IC 310 through the wiring included in an IC ground layer of the connection member 200. Since a first ground layer of the connection member 200 is disposed between the IC ground layer and the wiring, the IF signal or the base band signal and the RF signal may be electrically isolated within the antenna module.

Figure 5B:
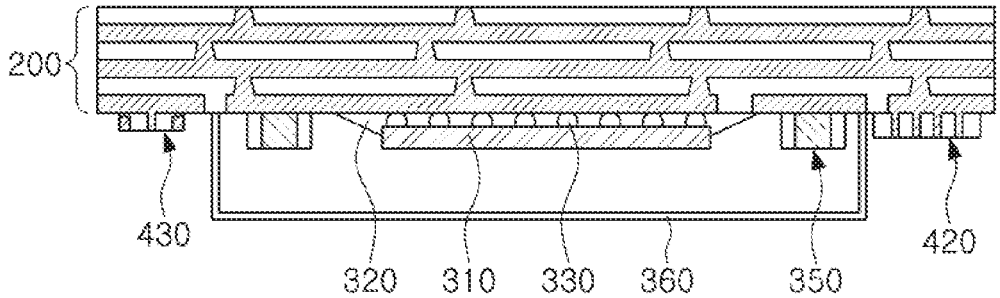

Referring to FIG. 5B, the antenna module may include at least portions of a shielding member 360, a connector 420, and a chip antenna 430.

The shielding member 360 may be disposed below the connection member 200 and may be disposed to confine the IC 310 together with the connection member 200. For example, the shielding member 360 may be disposed to cover (e.g., conformal shield) the IC 310 and the passive component 350 together or cover (e.g., compartment shield) the IC 310 and the passive component 350, respectively. For example, the shielding member 360 may have a hexahedron shape with one surface opened, and may have a receiving space of the hexahedron through coupling with the connection member 200. The shielding member 360 may be formed of a material having high conductivity such as copper to have a short skin depth, and may be electrically connected to the ground layer of the connection member 200. Therefore, the shielding member 360 may reduce electromagnetic noise that the IC 310 and the passive component 350 may receive.

The connector 420 may have a connection structure of a cable (e.g., a coaxial cable, a flexible PCB), may be electrically connected to the IC ground layer of the connection member 200, and may perform a function similar to the sub-board described above. That is, the connector 420 may be provided with an IF signal, a base band signal and/or power from the cable, or may provide the IF signal and/or the base band signal to the cable.

The chip antenna 430 may assist the antenna apparatus in transmitting and receiving the RF signal. For example, the chip antenna 430 may include a dielectric block having a dielectric constant greater than that of the insulating layer, and a plurality of electrodes disposed on opposite surfaces of the dielectric block. One of the plurality of electrodes may be electrically connected to the wiring of the connection member 200, and another electrode may be electrically connected to the ground layer of the connection member 200.

Figure 5C:
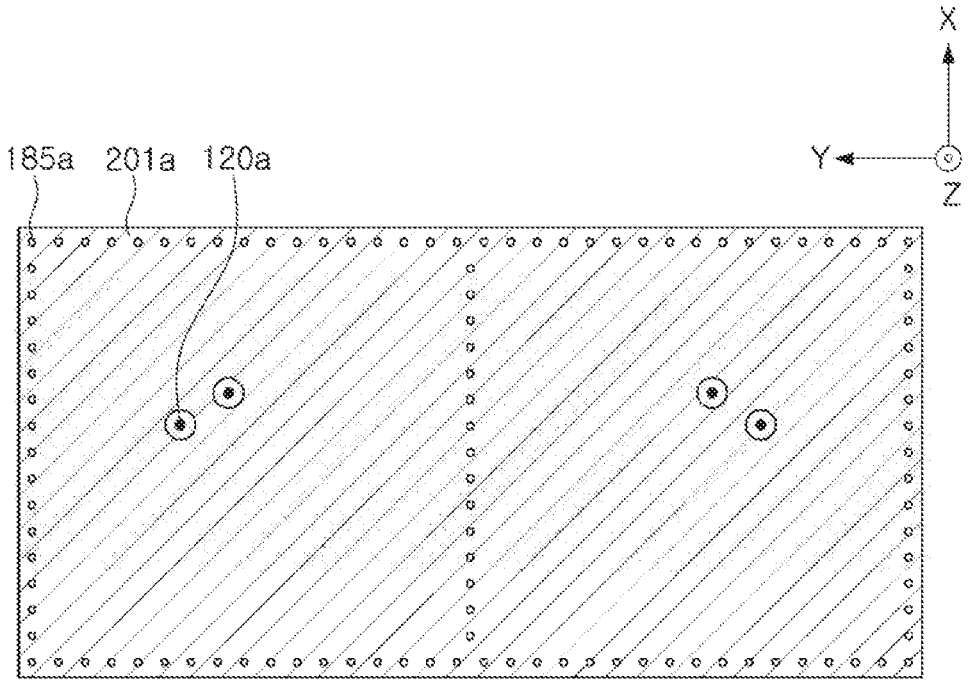

Referring to FIG. 5C, a ground layer 201*a* may have a through-hole through which the feed via 120*a* penetrates, and may be connected to the other end of a ground via 185*a*. The ground layer 201*a* may electromagnetically shield between the patch antenna pattern 110*a* and the feed line.

Figure 5D:
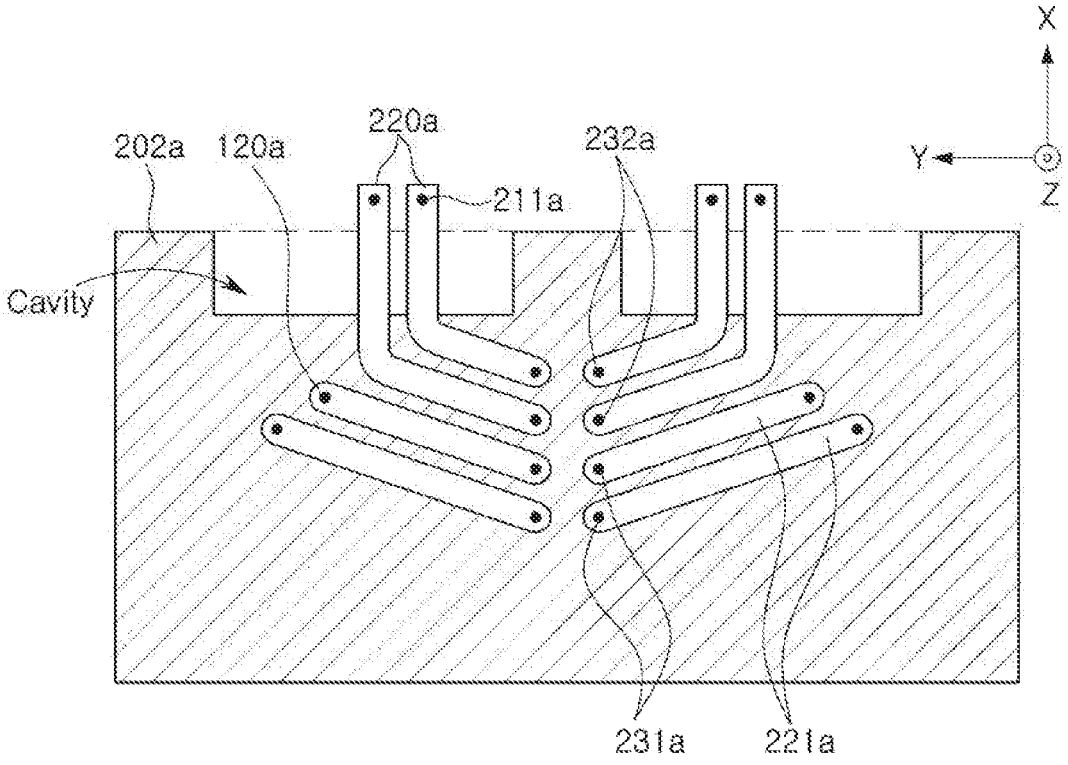

Referring to FIG. 5D, a second ground layer 202*a* may surround at least a portion of an end-fire antenna feed line 220*a* and a patch antenna feed line 221*a*, respectively. The end-fire antenna feed line 220*a* may be electrically connected to a second wiring via 232*a*, and the patch antenna feed line 221*a* may be electrically connected to a first wiring via 231*a*. The second ground layer 202*a* may electromagnetically shield between the end-fire antenna feed line 220*a* and the patch antenna feed line 221*a*. One end of the end-fire antenna feed line 220*a* may be connected to the end-fire antenna feed line 211*a*.

Figure 5E:
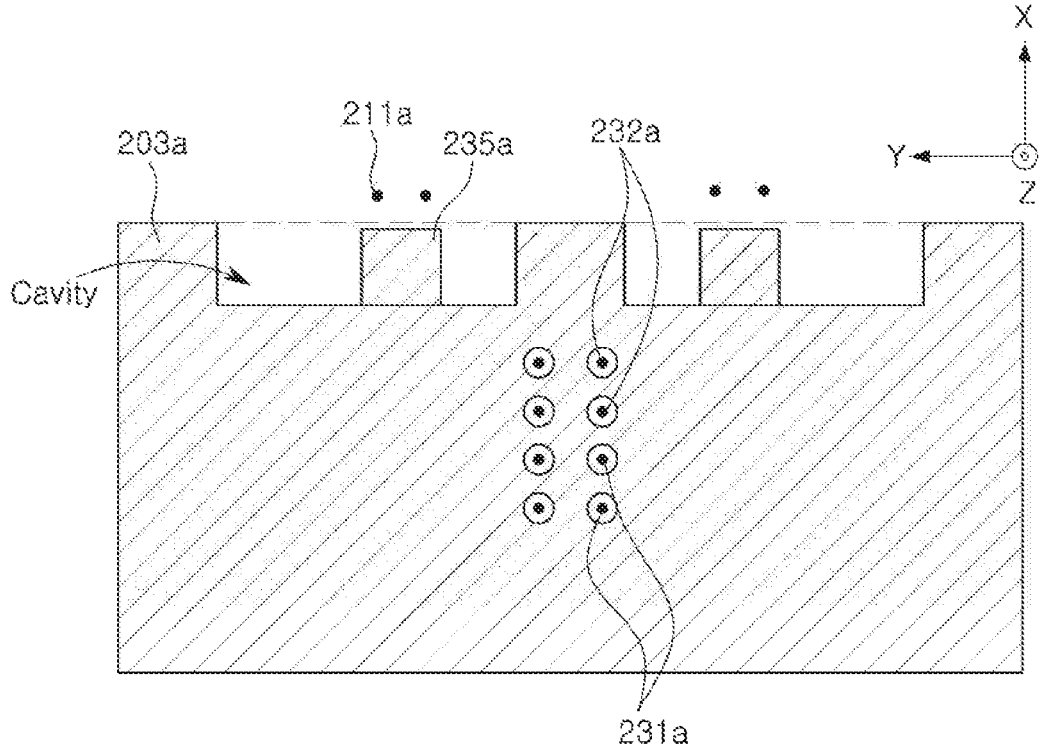

Referring to FIG. 5E, a third ground layer 203*a* may have a plurality of through-holes through which the first wiring via 231*a* and the second wiring via 232*a* pass, and may have a coupling ground pattern 235*a*. The third ground layer 203*a* may electromagnetically shield between the feed line and the IC.

Figure 5F:
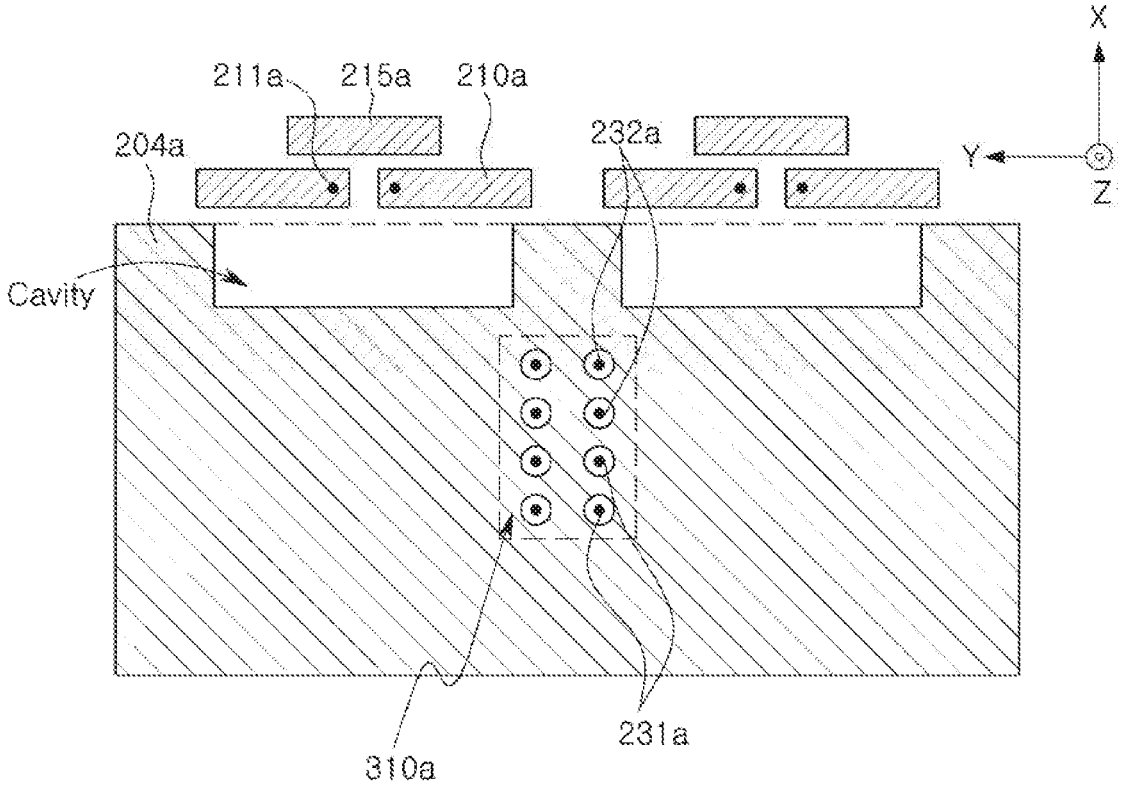

Referring to FIG. 5F, a fourth ground layer 204*a* may have a plurality of through-holes through which the first wiring via 231*a* and the second wiring via 232*a* pass. An IC 310*a* may be disposed below the fourth ground layer 204*a*, and may be electrically connected to the first wiring via 231*a* and the second wiring via 232*a*. The end-fire antenna pattern 210*a* and the director pattern 215*a* may be disposed at substantially the same height as the fourth ground layer 204*a*.

The fourth ground layer 204*a* may provide a circuit in the IC 310*a* and/or a ground used in the passive component as the IC 310*a* and/or as the passive component. Depending on the design, the fourth ground layer 204*a* may provide a transmission path of power and signal used in the IC 310*a* and/or the passive component. Therefore, the fourth ground layer 204*a* may be electrically connected to the IC and/or the passive component.

The second ground layer 202*a*, the third ground layer 203*a*, and the fourth ground layer 204*a* may have a depressed shape to provide a cavity. Accordingly, the end-fire antenna pattern 210*a* may be disposed closer to the IC ground layer 204*a*. The cavity may be disposed at a position different from the cavities described above in FIGS. 1 through 4C.

A top and bottom relationship and shape of the second ground layer 202*a*, the third ground layer 203*a*, and the fourth ground layer 204*a* may vary depending on the design. The fifth ground layer illustrated in FIG. 1 may have a structure/function similar to the fourth ground layer 204*a*.

Figure 6:
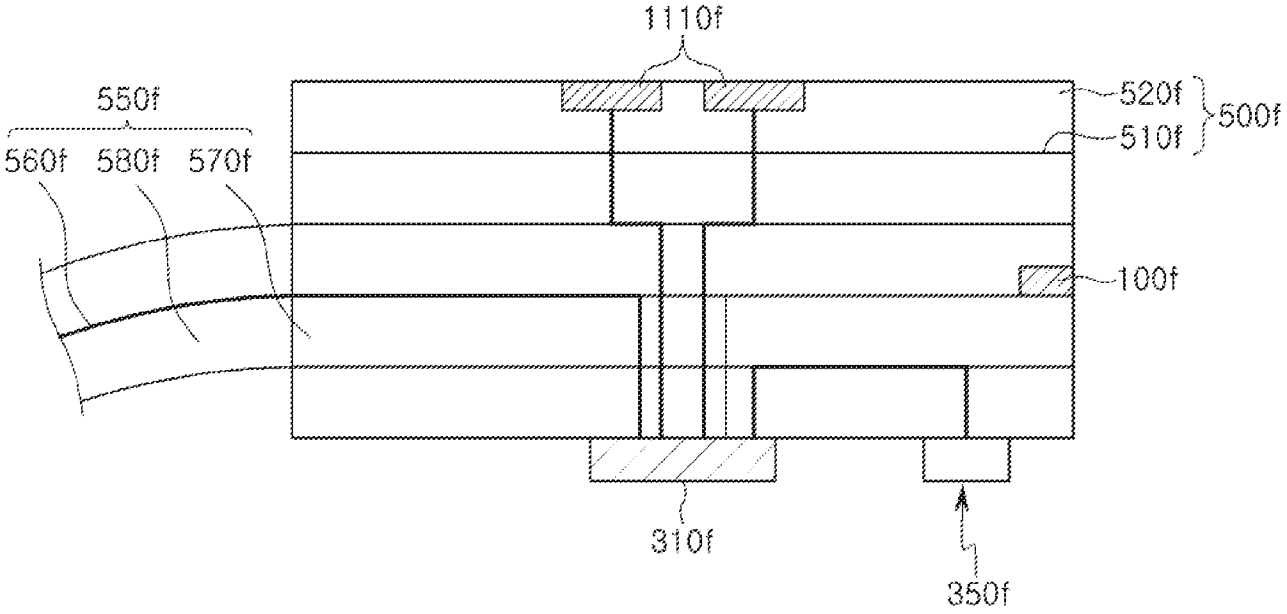
FIG. 6 is a view illustrating a modified structure of an antenna apparatus and an antenna module according to an example.

FIG. 6 is a view illustrating a modified structure of the antenna apparatus and the antenna module according to an example.

Referring to FIG. 6, the antenna module may have a structure in which an end-fire antenna 100*f*, a patch antenna pattern 1110*f*, an IC 310*f*, and a passive component 350*f* are integrated into a connection member 500*f*.

The end-fire antenna 100*f* and the patch antenna pattern 1110*f* may be designed in the same manner as the end-fire antenna described above and the patch antenna pattern described above, respectively, and may receive the RF signal from the IC 310*f* to transmit the RF signal or transmit the received RF signal to the IC 310*f*.

The connection member 500*f* may have a structure (e.g., a structure of a printed circuit board) in which at least one conductive layer 510*f* and at least one insulating layer 520*f* are stacked. The conductive layer 510*f* may have the ground layer and the feed line described above.

In addition, the antenna module may further include a flexible connection member 550*f*. The flexible connection member 550*f* may include a first flexible region 570*f* overlapping the connection member 500*f* and a second flexible region 580*f* not overlapping the connection member 500*f* when viewed in a vertical direction.

The second flexible region 580*f* may be flexibly bent in the vertical direction. Accordingly, the second flexible region 580*f* may be flexibly connected to a connector of a set board and/or an adjacent antenna module.

The flexible connection member 550*f* may include a signal line 560*f*. The IF signal and/or the base band signal may be transmitted to the IC 310*f* or transmitted to the connector of the set board and/or the adjacent antenna module through the signal line 560*f*.

Figure 7B:
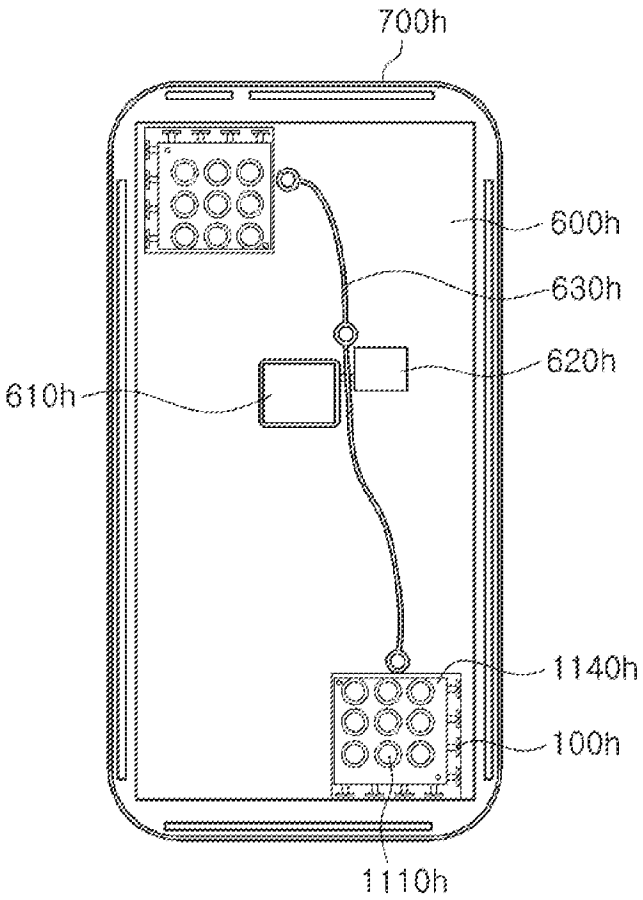
FIGS. 7A and 7B are plan views illustrating layouts of an antenna module in an electronic device according to an example.
Figure 7A:
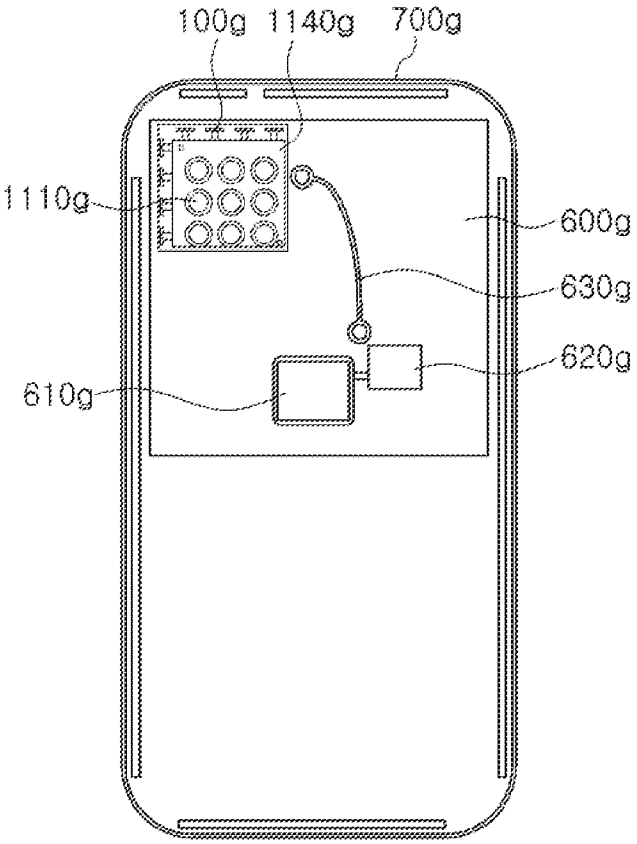

FIGS. 7A and 7B are plan views illustrating layouts of an antenna module in an electronic device according to examples.

Referring to FIG. 7A, an antenna module including an end-fire antenna 100*g*, a patch antenna pattern 1110*g*, and an insulating layer 1140*g* may be disposed to be adjacent to a side boundary of an electronic device 700*g* on a set board 600*g* of the electronic device 700*g*.

The electronic device 700*g* may be a smartphone, a personal digital assistant, a digital video camera, a digital still camera, a network system, a computer, a monitor, a tablet, a laptop, a netbook, a television, a video game, a smartwatch, an automotive component, or the like, but is not limited thereto.

A communications module 610*g* and a baseband circuit 620*g* may be further disposed on the set board 600*g*. The antenna module may be electrically connected to the communications module 610*g* and/or the baseband circuit 620*g* through a coaxial cable 630*g*. Depending on the design, the coaxial cable 630*g* may be replaced with the flexible connection member illustrated in FIG. 6.

The communications module 610*g* may include at least a portion of a memory chip such as a volatile memory (for example, a DRAM), a non-volatile memory (for example, a ROM), a flash memory, or the like; an application processor chip such as a central processor (for example, a CPU), a graphics processor (for example, a GPU), a digital signal processor, a cryptographic processor, a microprocessor, a microcontroller, or the like; and a logic chip such as an analog-digital converter, an application-specific IC (ASIC), or the like to perform a digital signal processing.

The baseband circuit 620*g* may generate a base signal by performing analog-digital conversion, and amplification, filtering, and frequency conversion of an analog signal. The base signal input and output from the baseband circuit 620*g* may be transmitted to the antenna module through a cable.

For example, the base signal may be transmitted to the IC through an electrical connection structure, a core via, and a wiring. The IC may convert the base signal into an RF signal of a millimeter wave (mmWave) band.

Referring to FIG. 7B, a plurality of antenna modules each including an end-fire antenna 100*h*, a patch antenna pattern 1110*h*, and an insulating layer 1140*h* may be disposed to be adjacent to a boundary of one side surface of an electronic device 700*h* and a boundary of the other side surface thereof, respectively, on a set board 600*h* of the electronic device 700*h*. A communications module 610*h* and a baseband circuit 620*h* may be further disposed on the set board 600*h*. The plurality of antenna modules may be electrically connected to the communications module 610*h* and/or the baseband circuit 620*h* through a coaxial cable 630*h*.

Meanwhile, the patch antenna pattern, the coupling patch pattern, the conductive array pattern, the feed via, the layout via, the grounding via, the shielding via, the ground layer, the end-fire antenna pattern, the director pattern, and the electrical connection structure of the examples may include a metal material (e.g., a conductive material such as copper (Cu), aluminum (Al), silver (Ag), tin (Sn), gold (Au), nickel (Ni), lead (Pb), titanium (Ti), or an alloy thereof), and may be formed by a plating method such as chemical vapor deposition (CVD), physical vapor deposition (PVD), sputtering, subtractive, additive, semi-additive process (SAP), modified semi-additive process (MSAP), or the like, but is not limited to such materials and formation methods.

The dielectric layer may be formed of FR4, liquid crystal polymer (LCP), low temperature co-fired ceramic (LTCC), a thermosetting resin such as an epoxy resin, a thermoplastic resin such as a polyimide resin, a resin in which the thermosetting resin or the thermoplastic resin is impregnated together with an inorganic filler in a core material such as a glass fiber (or a glass cloth or a glass fabric), for example, prepreg, Ajinomoto Build up Film (ABF), FR-4, Bismaleimide Triazine (BT), a photo imagable dielectric (PID) resin, generic copper clad laminate (CCL), or a glass or ceramic based insulating material. The dielectric layer may be filled in at least a portion of positions at which the patch antenna pattern, the coupling patch pattern, the conductive array pattern, the feed via, the layout via, the grounding via, the shielding via, the ground layer, the end-fire antenna pattern, the director pattern, the coupling ground pattern, and the electrical connection structure are not disposed in the antenna apparatus and the antenna module.

The RF signal disclosed herein may have a format according to wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the abovementioned protocols, but is not limited to such formats or protocols.

The antenna apparatus and the antenna module may improve the antenna performance or have the structure advantageous for miniaturization according to an efficient configuration of the plurality of coupling patch patterns and the effective dielectric constant.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

a ground layer comprising a through-hole;

a feed via disposed to pass through the through-hole;

a patch antenna pattern disposed on the ground layer and electrically connected to one end of the feed via;

a first coupling patch pattern disposed on the patch antenna pattern;

a second coupling patch pattern disposed between the first coupling patch pattern and the patch antenna pattern;

a dielectric layer disposed in at least of a portion a space between the first coupling patch pattern and the second coupling patch pattern so that a dielectric constant of at least a portion of a space between the patch antenna pattern and the second coupling patch pattern is lower than a dielectric constant of the space between the first coupling patch portion and the second coupling patch pattern;

electrical connection structures disposed on the ground layer and configured to support the dielectric layer; and grounding vias configured to electrically connect the electrical connection structures to the ground layer.

2. The antenna apparatus of claim 1, wherein the dielectric constant of at least a portion of the space between the patch antenna pattern and the second coupling patch pattern is lower than a dielectric constant of the dielectric layer.

3. The antenna apparatus of claim 1, wherein the dielectric layer comprises a cavity disposed between the first coupling patch pattern and the patch antenna pattern.

4. The antenna apparatus of claim 3, wherein the first coupling patch pattern is disposed on the dielectric layer and is exposed on one surface of the dielectric layer, and the second coupling patch pattern is disposed in the cavity.

5. The antenna apparatus of claim 4, wherein a lateral length of the first coupling patch pattern is longer than a lateral length of the second coupling patch pattern, and the lateral length of the first coupling patch pattern is shorter than a lateral length of the cavity.

6. The antenna apparatus of claim 5, wherein a lateral length of the patch antenna pattern is shorter than the lateral length of the second coupling patch pattern.

7. The antenna apparatus of claim 4, further comprising an upper dielectric layer disposed on the dielectric layer and surrounding the first coupling patch pattern.

8. The antenna apparatus of claim 1, further comprising a second dielectric layer disposed in at least a portion of a region between the ground layer and the patch antenna pattern, wherein at least a portion of each of the grounding vias is disposed in the second dielectric layer, and the electrical connection structures are disposed on the second dielectric layer.

9. The antenna apparatus of claim 8, wherein a dielectric constant of the second dielectric layer is lower than a dielectric constant of the dielectric layer.

10. The antenna apparatus of claim 1, further comprising conductive array patterns arranged to surround the first coupling patch pattern or the second coupling patch pattern along a side boundary of the first coupling patch pattern or the second coupling patch pattern and electrically connected to the electrical connection structures.

11. The antenna apparatus of claim 10, wherein the conductive array patterns includes:

first conductive array patterns disposed on a same level as the first coupling patch pattern;

second conductive array patterns electrically connected to the grounding vias; and layout vias connecting the first conductive array patterns to the second conductive array patterns.

12. An electronic device comprising:

the antenna apparatus of 1.

13. An antenna apparatus comprising:

a ground layer comprising a through-hole;

a feed via disposed to pass through the through-hole;

a patch antenna pattern disposed on the ground layer and electrically connected to one end of the feed via;

a first coupling patch pattern disposed on the patch antenna pattern;

a second coupling patch pattern disposed between the first coupling patch pattern and the patch antenna pattern;

a dielectric layer disposed in at least of a portion a space between the first coupling patch pattern and the second coupling patch pattern so that a dielectric constant of at least a portion of a space between the patch antenna pattern and the second coupling patch pattern is lower than a dielectric constant of the space between the first coupling patch portion and the second coupling patch pattern; and conductive array patterns arranged to surround the first coupling patch pattern or the second coupling patch pattern along a side boundary of the first coupling patch pattern or the second coupling patch pattern and comprising at least a portion disposed in the dielectric layer.

14. The antenna apparatus of claim 13, wherein the conductive array patterns include:

first and second conductive array patterns; and layout vias connecting the first conductive array patterns to the second conductive array patterns.

* * * * *